US012655646B2

(12) United States Patent
Abshire et al.

(10) Patent No.: US 12,655,646 B2
(45) Date of Patent: Jun. 16, 2026

(54) PORTABLE BIOMEDICAL UTILITIES CONSOLE

(71) Applicants: Preston Abshire, Nor, GA (US); Justin Abshire, Norcross, GA (US)

(72) Inventors: Preston Abshire, Nor, GA (US); Justin Abshire, Norcross, GA (US)

( * ) Notice: Subject to any disclaimer, the term of this patent is extended or adjusted under 35 U.S.C. 154(b) by 235 days.

(21) Appl. No.: 18/534,453

(22) Filed: Dec. 8, 2023

(65) Prior Publication Data

US 2024/0191524 A1 Jun. 13, 2024

Related U.S. Application Data

(60) Provisional application No. 63/431,505, filed on Dec. 9, 2022.

(51) Int. Cl.
*E04H 3/08* (2006.01)

(52) U.S. Cl.
CPC ..... *E04H 3/08* (2013.01)

(58) Field of Classification Search
CPC ..... E04H 3/00; E04H 3/08
See application file for complete search history.

(56) References Cited

U.S. PATENT DOCUMENTS 4,130,123 A 12/1978 Wines, Jr. et al.
6,256,936 B1 * 7/2001 Swensson ..... A47K 4/00 52/36.2
6,506,301 B1 1/2003 Peterson et al.
8,215,065 B2 7/2012 Gallant
8,460,544 B2 6/2013 Manfred
9,127,470 B2 9/2015 Lee
9,421,312 B1 8/2016 Marinan et al.
11,103,406 B1 * 8/2021 Channell ..... E04H 3/08
11,299,896 B2 4/2022 Gauthier et al.
11,773,613 B2 * 10/2023 Bruns ..... E04H 3/08 52/79.1
12,180,731 B2 * 12/2024 Jones ..... E04B 1/34815
2013/0154296 A1 * 6/2013 Blackwell ..... A61G 3/001 296/24.38
2014/0116870 A1 * 5/2014 Kamen ..... E04H 3/02 202/83

(Continued)

FOREIGN PATENT DOCUMENTS

DE 202004016882 U1 1/2005
FR 2377355 8/1978

(Continued)

OTHER PUBLICATIONS

Jonathan Maxwell Adams, Kingsley Flomo, Kurtis Scott Banville, Samuel Carl Mccallum, Design of Mobile Dialysis Treatment, May 1, 2015.

*Primary Examiner* — Chi Q Nguyen
(74) *Attorney, Agent, or Firm* — Balch and Bingham, LLP

(57) ABSTRACT

System involved with but not limited to an apparatus including a non-permanent, interchangeable, standalone console assembly for the portable provision of power, water, and drainage infrastructure for medical equipment, including, but not limited to various types of dialysis and other medical treatments. Embodiments of the present disclosure also include numerous redundancies designed to allow for continued medical treatment in the event of a failure of one or more utility subsystems.

19 Claims, 17 Drawing Sheets

(56) References Cited

U.S. PATENT DOCUMENTS

| | | | | |
|---|---|---|---|---|
| 2014/0290151 | A1* | 10/2014 | Lee | E04B 2/74 52/32 |
| 2017/0333267 | A1* | 11/2017 | Anandasabapathy | B60P 3/32 |
| 2021/0268160 | A1 | 9/2021 | Jor | |
| 2023/0190558 | A1* | 6/2023 | Kim | A61G 10/02 600/21 |
| 2024/0074622 | A1* | 3/2024 | Kepler | A47K 3/325 |
| 2024/0191524 | A1* | 6/2024 | Abshire | E04H 3/08 |
| 2025/0306560 | A1* | 10/2025 | Tong | G05B 19/052 |

FOREIGN PATENT DOCUMENTS

| | | | |
|---|---|---|---|
| FR | 2377355 | A1 | 8/1978 |
| WO | 2022127983 | | 6/2022 |

* cited by examiner

PORTABLE BIOMEDICAL UTILITIES CONSOLE

CROSS-REFERENCE TO RELATED APPLICATION

This application claims the benefit of, and priority from, U.S. Provisional Application No. 63/431,505, filed Dec. 9, 2022, the disclosures of which are hereby incorporated by reference in their entirety as if fully set forth herein.

TECHNICAL FIELD

Embodiments of the present disclosure relate generally to medical equipment, including, but not limited to the provision of portable utilities infrastructure to dialyzers and other medical equipment that requires power, water, and drainage to function, such as in dentistry. More specifically, aspects of the present disclosure relate to portable, modular systems that may supply water, electricity, data transmission, and drainage to one or a plurality of dialyzers or other medical equipment enabling the operation of dialysis or other systems free from fixed infrastructure disposed within permanent construction. Further aspects of the present disclosure include one or more drainage, data, and power redundancies in the event of a failure in any individual subsystem.

BACKGROUND

Hemodialysis and peritoneal dialysis have become increasingly prevalent as health trends in the United States and around the world have resulted in increasing diagnoses of kidney disease and corresponding treatments. Dialysis is a front-line treatment for end-stage kidney disease, chronic kidney disease, and renal failure, performing the essential function of the kidneys to remove undesirable substances from the patient's blood.

Peritoneal dialysis systems are known in the art, and operate as an artificial kidney system by using the patient's peritoneal membrane to filter blood. Peritoneal dialysis requires a peritoneal access device (usually a catheter), dialysate (an aqueous solution used to remove impurities), an apparatus capable of pumping and draining dialysate from the patient's peritoneal cavity, and various accessories. The peritoneal dialysis system removes impurities from the patient's blood by pumping dialysate into the patient's peritoneal cavity via the access device, where the dialysate dwells for a period of time while toxins and other undesirable substances pass through the peritoneal membrane and into the dialysate in the peritoneal cavity. The dialysate captures the toxins, which are removed from the body along with the dialysate. This process may be repeated over the course of a treatment. The machine that performs the pumping and draining of the dialysate or other wastewater requires a specialized power source and drainage pumping that is both reliable enough to be used in medical treatment and may be used to dispose of used dialysate, which is medical waste, or other medical wastewater. As used herein, "wastewater" may refer to used dialysate or other waste fluids generated by medical treatments.

Hemodialysis filters toxins directly out of the blood and usually consists of an extracorporeal blood system, a dialyzer, a dialysate delivery system, and various accessories. The patient's blood flows through the extracorporeal blood system to the filtration compartment of the dialyzer, which usually consists of two compartments, one for blood and the other for dialysate separated by a membrane. The toxins in the patient's blood pass through the membrane into the dialysate. Cleansed blood flows back into the patient while the used dialysate, which is medical waste, is cycled out to drain. The extracorporeal blood system includes mechanisms and alarms that keep blood moving safely from the patient, through the dialyzer, and back into the patient.

Diabetes, which has become increasingly prevalent in Americans, often results in chronic kidney disease or diabetic nephropathy and as a result has led to an increased demand for dialysis treatment. Approximately 1 in 3 adults with diabetes suffers from chronic kidney disease, and the prevalence of both type 1 and type 2 diabetes is expected to increase by more than 50% between 2015 and 2030. The costs of diabetes and complications thereof have a significant societal cost, owing in part to the cost of treatment for resulting kidney disease, which includes dialysis.

Complications from COVID-19 include kidney injuries, with an estimated 3-9% of COVID-19 patients developing acute kidney injuries. As a result, dialysis also has applications in the treatment of some cases of COVID-19 and what has come to be known as "long COVID."

The utility of the present disclosure is not limited in scope to use in dialysis treatment, but may also be used to facilitate other medical treatments and other operations and activities requiring the use of reliable electric, water, and drainage utilities.

Because functional medical equipment that accomplishes dialysis treatment require specialized dialysate fluid supply equipment, specialized fluid drainage piping and collection equipment, and highly reliable conduits for electricity and patients' medical and other data collected by dialysis equipment, many dialysis providers integrate specialized utility infrastructure directly into the buildings where dialysis treatment takes place. This building infrastructure, which includes equipment capable of supporting the specialized mechanical, electrical, plumbing, and data needs of dialysis equipment, is both very expensive to construct and is confined to use only in the single location where it is installed.

The present disclosure improves over the prior art by eliminating reliance upon supplying required dialysis utilities infrastructure in a permanent, immovable building construction while also providing portable, interchangeable, reusable, and comparably inexpensive dialysis infrastructure capable of transforming a pre-existing space into one capable of supporting one or more dialysis treatments while still supporting multiple system redundancies that reduce to a near nullity the possibility of utility failures that could adversely affect dialysis or other medical treatments. In addition, the disclosed system's portability makes it advantageous to use in other applications, such as in a temporary or mobile facility. In an exemplary non-limiting application, the present disclosure may include a freely configurable modular cabinet with water supply, dialysate, or other medical wastewater drainage and/or storage plumbing, electrical utility hardware configured for use with dialysis equipment, and data transmission hardware that may be used to transmit patient medical data to medical providers. The disclosed apparatus may be portable and modular, capable of supporting one or more concurrent dialysis treatments with one or more consoles provided in electrical and fluid communication with one another. The disclosed system may also include additional assemblies used to control and extend the distance between multiple portable biomedical utilities consoles.

SUMMARY

It is an object, feature, and/or advantage of the present disclosure to provide an improved portable biomedical utility apparatus and accessories and methods of use thereof that overcome deficiencies in the prior art. In accordance with one exemplary aspect, a portable cabinet is provided with biomedical utility subsystems, including but not limited to plumbing equipment directed to water supply and fluid dialysate or other wastewater drainage and/or collection, electrical equipment directed to the supply of reliable power and including electrical cabling, circuit breakers, standard and/or specialized electrical outlets, and uninterruptible power supply optionally including an inverter, battery, and power factor correction, control hardware including series of configured relays, contactors, and sensors that control and monitor some or all of the provided utility functions, equipment for data transmission, and connectors adapted to place each utility in respective communication with corresponding external utilities, equipment used in dialysis and other treatments, and to other portable biomedical utilities consoles and accessories.

It is an additional object, feature, and/or advantage of the present disclosure to provide a portable and modular biomedical utility apparatus and methods of use thereof that provide plumbing and electrical systemic redundancies for use in conjunction with dialysis or other medical equipment when a plurality of consoles are used in conjunction with one another such that, in the event of a failure of plumbing or electrical utility system of one console, another console may provide backup plumbing, data, and/or electrical utility service.

BRIEF DESCRIPTION OF THE DRAWINGS

The accompanying drawings, which are incorporated in, and which constitute a part of this specification, illustrate exemplary constructions and procedures in accordance with the present disclosure and, together with the general description of the disclosure given above and the detailed description set forth below, serve to explain the principles of the disclosure wherein.

Figure 1:
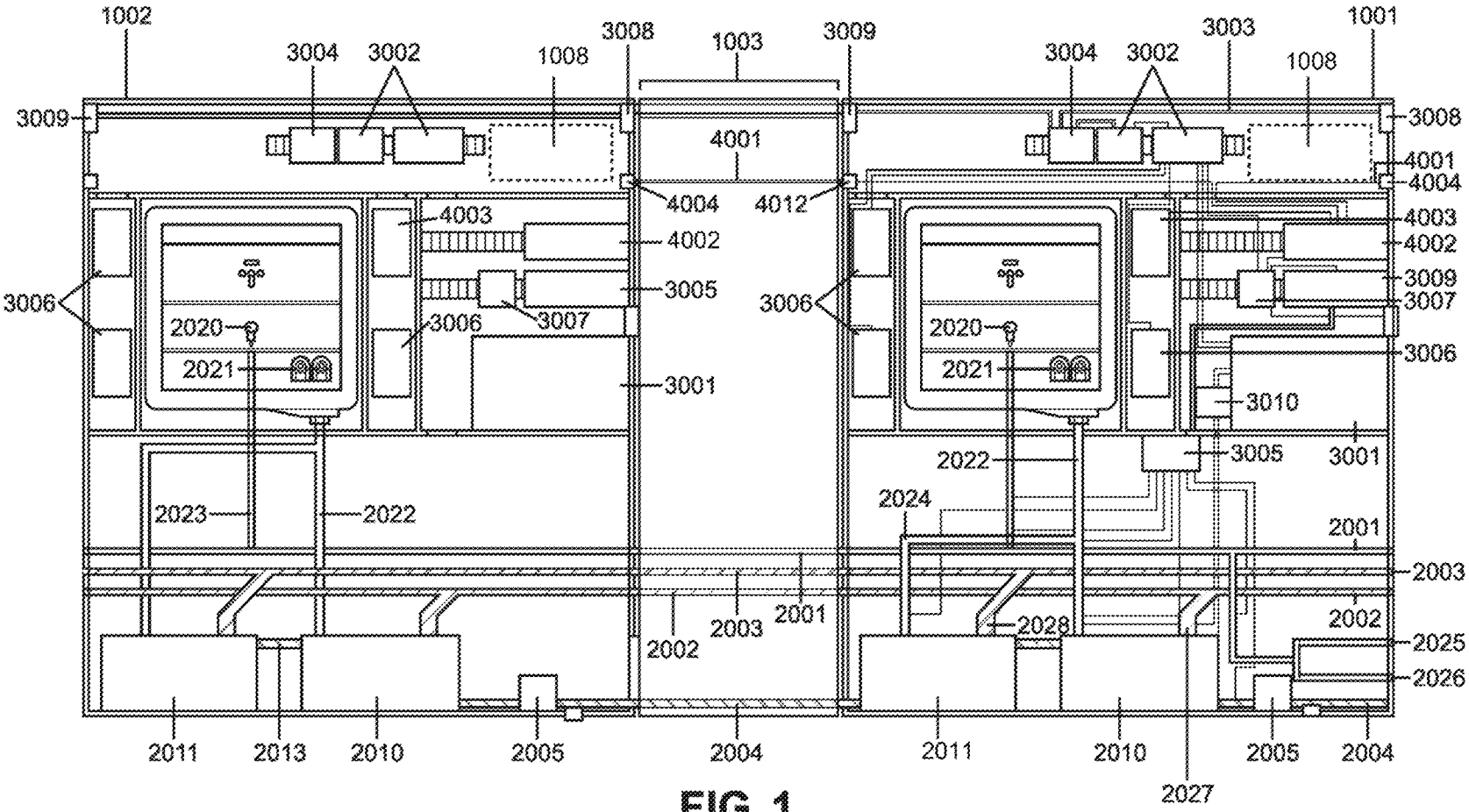
FIG. 1 is a component map of an exemplary configuration of the disclosure displaying two standalone consoles, a unit with connections to facility utilities and data and an intermediate or end-of-line unit, in fluid, electrical, and data communication with one another via a coupler panel.

While constructions consistent with the present disclosure have been illustrated and generally described above and will hereinafter be described in connection with certain potentially preferred embodiments and practices, it is to be understood that in no event is the disclosure limited to such illustrated and described embodiments and practices. On the contrary, it is intended that the present disclosure shall extend to all alternatives and modifications as may embrace the general principles of this disclosure within the full and true spirit and scope thereof. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION

It is an object, feature, and/or advantage of the present disclosure to provide an improved and portable biomedical utilities infrastructure apparatus and methods of use thereof that overcome deficiencies in the prior art. The disclosed portable biomedical utilities console provides advantages over stationary utilities infrastructure built into dialysis treatment facilities provided in prior art.

A discussion of the prior art is helpful to illustrate how the present disclosure overcomes deficiencies in the prior art. In order to function, dialysis machines used in dialysis treatment typically require a supply of electricity and water, as well as a repository or drain into which used dialysate can drain and be collected or otherwise disposed of. A typical dialysis machine requires a source of water to be mixed with chemicals in order to form an aqueous solution, dialysate, which is used in dialysis. At present, these utilities are typically built into specialized facilities designed for the purpose of facilitating multiple simultaneous dialysis treatments.

The present disclosure overcomes deficiencies in the prior art by effectively removing the need for permanent utility infrastructure required by dialysis and other medical machines by effectively replacing it with a plurality of portable, non-permanent, and modular cabinets capable of the reliability demanded in medicine. In so doing, construction costs are reduced and the need for traditional construction (i.e., plumbing and electrical utilities disposed within the walls of the building housing the treatment room) is significantly reduced as the number of utility connections needed for dialysis and other medical treatment is reduced. In addition, the cost of converting an existing structure to one capable of supporting multiple simultaneous dialysis or other treatments is greatly reduced.

It is an object, feature, and/or advantage of the present disclosure to provide an improved biomedical utility console that includes plumbing infrastructure including piping disposed in fluid communication with an external water supply, drain piping provided in fluid communication with a valve disposed in the housing of the console and configured to receive an adapter capable of placing the drain piping in fluid communication with the dialysate output port of a dialyzer or wastewater output of another medical device, the drain piping in turn may be provided in fluid communication with an assembly including an electric pump and wastewater tank or a sloping drainage conduit and gravity-fed removable container, electrical hardware configured to provide electricity to sub-systems within the console and dialysis and other equipment connected thereto, the electricity subsystem including an uninterruptible power supply and surge protection integrated therein, electronic equipment configured to receive, convey, and transmit information and commands, control hardware including series of configured relays, contactors, and sensors that control and monitor some or all of the provided utility functions, and connectors adapted to place each utility in respective communication with corresponding external utilities and equipment used in dialysis treatment.

Multiple examples of the present disclosure may be adapted to be placed in fluid communication with one another. In one such exemplary configuration, a first portable biomedical utilities console may receive hot and cold water from an external source, and a second console may be placed in fluid communication with a first console such that water provided from an external source may be communicated to an exemplary second console from an exemplary first console, wherein both consoles may provide water to respective medical devices provided in fluid communication with a first and second console. Additional consoles may be added to an exemplary console system in a series or relay line. As used herein, "relay" means receive and pass on water, wastewater fluid, electricity, or data.

An exemplary portable biomedical utilities console may include hardware configured for power distribution from an external power source to dialysis or other medical equipment and other portable biomedical utilities consoles. In this exemplary embodiment, an electricity distribution system is disposed within a housing and is adapted to be placed in electrical communication with an external power source, one or more other portable biomedical utilities consoles, and dialysis or other medical equipment, including hemodialysis and peritoneal dialysis treatment delivery systems. An exemplary power distribution system disposed within a portable biomedical utilities console may include an electrical cable bus provided in electrical communication with external adapters capable of communicating an electrical current to and from the console, and providing a primary source of electricity to each exemplary console. An exemplary power cable bus may be provided in electrical communication to one or more sets of circuit breakers capable of preventing surge currents from damaging exemplary utilities systems disposed within a console and dialysis or other medical equipment in electrical communication therewith, which in turn are provided in electrical communication with the utilities systems disposed within the console housing. A power cable bus may communicate electricity through one or more circuit breakers or directly to subsystems within the console that require electricity to operate, including, but not limited to a pump, network hub, and data receiving and transmitting module, and to a means of communicating electricity to dialysis or other medical equipment, such as a ground-fault circuit interrupter outlet mounted to the housing of the console, which in turn may provide additional surge protection for dialysis or other medical equipment. One or a plurality of electric receptacle disposed in the exterior of each console unit to provide electricity to a dialyzer or other medical equipment.

An exemplary portable biomedical utilities console may also include additional subsystems configured to provide power redundancies in the event of a power loss from the external power source. An uninterruptible power supply (UPS) module, optionally including a battery, inverter, and surge protector may be provided within the housing of the console to provide protection from interruptions or imbalances to input power. In the event of an external power loss, a UPS module may be configured to provide electricity not only to any dialysis equipment in direct electrical communication with the console, but also to other consoles and corresponding dialysis equipment. Such a configuration provides additional redundancies corresponding to the number of exemplary consoles provided. Each UPS module may also be provided in communication with an alarm system to notify medical providers of an external power failure and/or a charge meter disposed on the console exterior communicating the level of charge of the UPS battery.

Exemplary circuit breakers provided in electrical communication with the main power bus and subsystem components or to an outlet adapted to provide electricity to a dialysis machine, other medical equipment, and other accessories may optionally be configured for the power capacity required for the specific configuration or application and/or to prevent damage or degraded performance caused by overcurrent or power surge.

One or more exemplary water supply lines may be disposed within the console housing and provided in fluid communication with a plurality of water ports disposed on the console housing. Exemplary water ports disposed on the console housing may be adapted to receive a plurality of water line connectors, which may be used to place the console in fluid communication with the water intake of a dialysis machine, the water line of another console, and/or an external source of water suitable for use in dialysis treatment. Each exemplary port may be provided in adjacent fluid communication with a valve as a means of controlling the flow of water through an exemplary console and to dialysis equipment provided in fluid communication therewith. An exemplary valve adapted to be placed in fluid communication with a dialysis machine may be provided in communication with a sensor configured to detect a number of water characteristics, including but not limited to temperature, pressure, and rate of flow. An exemplary water output sensor is placed downstream from any valve provided to control the flow of water to dialysis equipment. One or two water intake lines may be placed in fluid communication with an external source water lines of cold or hot and cold water, respectively. Water temperature control may be provided by an exemplary thermostat mixing valve placed in fluid communication with both hot and cold water lines. Water pressure conditioning may be provided by a reduced pressure zone (RPZ) assembly, including a backflow preventer disposed within the console and provided in fluid communication with an output valve configured to be placed in fluid communication with the water intake of dialysis or other medical equipment. Embodiments of the present disclosure include the use of some form of backflow prevention and pressure reduction to manage water pressure output to sensitive medical equipment. Each water intake or output port may be provided in fluid communication with a valve as a means of controlling the flow of water through an exemplary console and from dialysis equipment provided in fluid communication therewith.

One or more exemplary fluid drainage lines may be disposed within a console housing and provided in fluid communication with a plurality of ports disposed on the console housing. Exemplary drainage ports disposed on the console housing may be configured to place the console in fluid communication with the dialysate output of dialysis machine, the drainage line another console, and/or an external drain. Each exemplary port may be provided in fluid communication with a valve as a means of controlling the flow of used dialysate or other wastewater through an exemplary console and from dialysis equipment provided in fluid communication therewith. A sensor may be placed in adjacent fluid communication to a used dialysate intake port to detect a number of characteristics of used dialysate fluid or other wastewater, including but not limited to rate of flow, pressure, and temperature.

An exemplary portable biomedical utilities console may be configured for pump-assisted or gravity-assisted drainage of used dialysate or wastewater. An optional container for storing used dialysate may be provided within the console housing in either a pump-assisted or gravity-assisted drainage configuration. In an exemplary pump-assisted drainage configuration, continuous duty suction pumps extract used dialysate wastewater at the same rate the waste fluid enters the console. Additionally, in an exemplary pump-assisted drainage configuration, a repository for used dialysate, which may be a removable or fixed container, is disposed in the housing of the exemplary console and is provided in fluid communication with one or more pumps. Exemplary continuous duty suction pumps may include a self-priming pump mounted in-line and configured to operate at low revolutions per minute (RPMs) and at different speeds. An exemplary pump may be disposed on an exemplary wastewater tank disposed within the console housing.

In an exemplary gravity-assisted drainage configuration, the slope of the drain conduit may be adjusted such that used dialysate or wastewater flows toward a facility drain. In this exemplary gravity-assisted configuration, the slope of the drainage pipe within each modular cabinet may be adjusted, optionally through the use of a plurality of pipe collars within each cabinet. Such pipe collars may be raised to a higher or lower height within each cabinet such that the slope of the entire drainage conduit gradually descends toward the facility drain or other means of collecting wastewater. Exemplary pipe collars may include a protrusion that can be affixed to one of a series of vertical openings in a rail disposed inside each modular cabinet. Each rail has numerous vertical openings at various heights, allowing the slope and height of the drain pipe within each cabinet to be adjusted such that wastewater flows toward a facility drain.

An exemplary low-RPM pump is advantageous in dialysis applications because drainage of used dialysate or wastewater is typically slow and in terms of reliability as low-RPM function places lower stress on the motor of an exemplary pump. In the event used dialysate or other wastewater outpaces the drainage rate provided by the pump, a variable frequency drive (VFD) motor controller may be provided to adjust the speed of the pump, and therefore, the rate of drainage. In an exemplary embodiment, a VFD controller may be configured to increase pump speed when triggered by a sensor disposed within the interior of a wastewater tank. When wastewater accumulates above a certain amount, a sensor configured to monitor wastewater level in the tank and signals the VFD controller to increase the speed of a pump provided in fluid communication with the wastewater tank to compensate for additional wastewater. In another exemplary embodiment, a VFD controller is operated manually from an exemplary control panel disposed on the housing of a console. An exemplary sensor configured to monitor wastewater level in the tank may be a float sensor.

In one exemplary embodiment of a portable biomedical utilities console with pump-assisted drainage, two fluid drainage lines are disposed within a console housing to provide redundancy in the event of pump failure. A first drainage line is provided in fluid communication with a plurality of drainage ports disposed on the exterior of the console housing and an exemplary first pump. A second drainage line is provided in fluid communication with a plurality of drainage ports disposed on the exterior of the console housing and an exemplary second pump. An exemplary first pump may be provided in fluid communication with an emergency exterior drain port and an exterior port, which is, in turn, provided in fluid communication with the used dialysate output of a dialyzer or the wastewater output of another medical device. A first pump is provided in fluid communication with a second pump, a first emergency drain line in fluid communication with another drainage port disposed on the exterior of the console, and a second emergency drain line provided in fluid communication with a hose bib disposed on the exterior of an exemplary console. An exemplary second pump may also be provided in fluid communication with the fluid line connecting the used dialysate port to a first pump and an emergency drain line in fluid communication with a port disposed on the exterior of an exemplary console. Both pumps are provided in electronic communication with a wastewater level sensor capable of detecting the operability, speed, and other aspects of each respective pump. In this configuration, ordinary operation of the console occurs when the used dialysate or other wastewater is pumped through a first pump and out of an exemplary embodiment of a console via a first drainage line. If a first pump fails or operates at reduced capacity, the float of an exemplary sensor configured to monitor wastewater level is triggered when the wastewater tank associated therewith fills with wastewater because the wastewater is entering the tank faster than the pump is pushing it out of the tank. Triggering an exemplary float sensor activates the operation of a second exemplary pump. In this embodiment, the wastewater instead is pumped through a first tank provided in fluid communication with a first pump to a second tank provided in fluid communication with a second tank and out of an exemplary console via a second drainage line.

The exemplary embodiment of a console with pump-enabled drainage system gains additional redundancies when one console housing two pumps is placed in fluid communication to another exemplary such console. In such situations, if both pumps fail within one console, an exemplary electrically-actuated valve in fluid communication with a first emergency drainage line will open and used dialysate or other wastewater will flow from a dialyzer through an exemplary first tank provided in fluid communication with a first pump, and through a first emergency drainage line to a second pump of a second exemplary console provided in fluid communication with the first. A plurality of portable biomedical utilities consoles therefore provides redundancies in the event both pumps in a console fail. In an exemplary embodiment, an electrically actuated valve in fluid communication with a first emergency drainage line will open when a sensor configured to detect wastewater level disposed in a wastewater tank is triggered by wastewater within a wastewater tank rising to the level of the float sensor. In this exemplary configuration wherein a first emergency drainage line is provided in fluid communication to a second emergency drain line disposed in a second console, when the valve in fluid communication with a first emergency drainage line opens the wastewater is allowed to flow into the adjacent console, which receives the wastewater load of the failed console.

In the event of catastrophic failure of all pumps in a console relay-line, wastewater may flow by operation of gravity out of the console via a second emergency drain line in fluid communication via an exemplary hose bib, which may be provided in fluid communication with an external drain.

In another exemplary embodiment of a portable biomedical utilities console, drainage and collection of used dialysate or other medical-waste byproducts may be accomplished by action of gravity. In this exemplary embodiment, a port configured to receive used dialysate or other wastewater is disposed on the exterior of an exemplary console and is provided in fluid communication with a container disposed on the bottom of an exemplary console and a wastewater drainage conduit. A container may be provided in fluid communication with an opening disposed in the top of an exemplary console via an exemplary conduit, which may be used to communicate cleaning fluid to drain pipes and treat them for the buildup of proteins deposited thereto from wastewater. In an exemplary gravity-assisted drainage configuration, the slope of the drain conduit may be adjusted within each console such that used dialysate or wastewater flows toward a facility drain or other means of collecting wastewater once the wastewater conduits of each individual console are placed in fluid communication with one another in a relay line. In this exemplary gravity-assisted configuration, the slope and height of the wastewater conduit within each modular cabinet may be adjusted such that the overall slope of the relay line wastewater conduit descends toward a facility drain or other means of collecting wastewater.

A computerized module may be provided in electronic communication with all sensors and electrically-actuated valves disposed in an exemplary portable biomedical utilities console. An exemplary data module may be provided in electric communication with an appropriate breaker box as a power source, and in electronic communication with a network communication module capable of receiving and transmitting data and commands wirelessly and/or via wired data transmission to and from dialysis equipment, computers, and other medical equipment. Collected and transmitted data may include, but is not limited to, a patient's medical data. In addition to collecting and monitoring a patient's health data, an exemplary computerized module may also collect and monitor data related to the function of the console and any dialysis equipment used in conjunction therewith. An exemplary computerized module may also be used to receive and implement commands from a medical provider or other console operator, and to implement automated control programs such as the opening and closure of redundancy valves in the event of a drainage subsystem component failure.

In an exemplary embodiment of a portable biomedical utilities console, all fluid and electrical connection components are disposed in regular corresponding positions on an exterior console housing. In such an embodiment, when a plurality of consoles are lined up next to one another, corresponding utility connectors will be adjacent to one another. For example, a primary drain line of one exemplary console will align with the primary drain line of another exemplary console, a clean water line of one exemplary console will align with the clean water line of another exemplary console, and the main power bus of an exemplary console will align with the main power bus of another console. Such a configuration allows the consoles to be easily attached and detached within a given space, which in turn enables the layout of a dialysis treatment space to be easily configured.

An exemplary portable biomedical utilities console may include a control panel disposed on the exterior housing that both communicates information to the medical provider and can be used to operate the function of the utility subsystems within the console. An exemplary control panel may be provided in electronic or analog communication with all sensors disposed within a console housing and may be configured to communicate information such as the failure of a subsystem such as electrical (e.g., a circuit breaker trip or use of the UPS), drainage (e.g., pump failure of either the primary or backup pump, or both), and/or water supply (e.g., leak alarm). An exemplary control panel may also be used to monitor information localized to a given console, such as water pressure, water temperature, and power consumption.

An exemplary portable biomedical utilities console may be equipped with redundant 12-volt power supplies including a series of analog relays, contactors, and sensors configured to automatically control and monitor the subsystems within an exemplary console. Such a configuration ensures redundancy and ease of maintenance.

Additional features may be added to an exemplary portable biomedical utilities console for added convenience. Wheels may be affixed to the bottom of each console to allow for ease of placement or reconfiguration of a dialysis or other treatment room. Exemplary consoles need not be placed in direct connection with one another. When dialysis or other treatment room layouts call for additional space between dialysis or other treatment chairs, the space between consoles may be extended by placing between consoles an exemplary adjustable coupler panel. An exemplary adjustable coupler panel may include a cabinet assembly with utilities connectors disposed in locations corresponding to the placement of the same utility connectors in an exemplary portable biomedical utilities console. In such an embodiment, when a plurality of consoles are lined up next to one another in a relay, corresponding utility connectors will be adjacent to one another. For example, a primary drain line of one exemplary console will align with the primary drain line of an exemplary adjustable coupler pane, which may then be aligned with the primary drain line of another exemplary console, and so on.

An exemplary multipoint head control unit may be provided in wired or wireless electronic communication with all portable biomedical utilities consoles in a given console chain, dialysis treatment space, or dialysis treatment facility. An exemplary head control unit may be capable of receiving medical provider commands through digital or analog controls disposed on the exterior of the head control unit, or remotely from another digital computing device. The head control unit may also be capable of receiving information from system components of a plurality of consoles and transmitting that information back to the user through a provided control panel disposed on the exterior of the head control unit housing. Such information may include, but is not limited to, clean water pressure, rate of flow and temperature at all connected consoles, the temperature, rate of flow, and pressure of incoming externally-sourced water, whether any subsystem faults have been detected at any console, the status of each pump, network status, and various alarms for leak detection, the activation of a UPS, or a high level of used dialysate fluid or wastewater. A medical provider may input commands, such as a valve startup or shutoff command, various valve control commands, and alarm shutoff.

DETAILED DESCRIPTION OF DRAWINGS

FIG. 1 is a component map of an exemplary configuration of the disclosure illustrating a console unit with connections to facility utilities 1001 in fluid, electrical, and data communication with an intermediate or end-of-line console unit 1002 via an adjustable coupler panel 1003. A fresh water conduit 2001 comprised of sections of pipe housed within each console unit and coupler panel may be provided in fluid communication with an external source of fresh water. Each section of fresh water conduit may be disposed in corresponding locations within each modular cabinet so that they may be connected to one another in a relay line wherein a fresh water conduit 2023 supplies fresh water to one or a plurality of external dialyzers via an output 2020 disposed in each cabinet unit. A primary wastewater conduit 2002 capable of carrying wastewater to an external drain may be comprised of sections of pipe provided in fluid communication with one another. In this exemplary configuration, the primary wastewater conduit 2002 is also provided in fluid communication with a primary tank assembly 2010 via a wastewater conduit 2027. A primary tank assembly 2010 may be provided in fluid communication with the used dialysate output of an external dialyzer via an external connector 2021 and intermediate wastewater conduit 2022, as well as a secondary tank assembly 2011. A secondary tank assembly 2011 may also be provided in fluid communication with the used dialysate output of an external dialyzer via an external connector 2021 and intermediate wastewater conduit 2024. An emergency wastewater conduit 2004 may also provide fluid communication between tank assemblies of multiple consoles and an external drain 2005, which may be a hose bib. In a console unit with connections to external utilities, an emergency wastewater conduit 2004 may also be provided in fluid communication with an external drain, in addition to a second external drain via a hose bib 2005. Secondary tank assemblies 2011 either individually or in a relay line may be provided in fluid communication with a secondary wastewater conduit 2003 which in turn may carry wastewater to an external drain. In this exemplary configuration under normal operating conditions, fresh water enters the series through the fresh water conduit 2001 and supplies external dialyzers with fresh water conveyed through a conduit 2023 and the external connector 2020. Used dialysate returns from the dialyzer connection 2021 and passes through a wastewater conduit 2022 to a primary tank assembly 2010. The primary tank assembly 2010, which comprises a tank in fluid communication with a pump, forces water out of the tank and into the primary wastewater conduit 2002 via an intermediate wastewater conduit 2027, where wastewater may be conveyed to an external drain. Wastewater may also be conveyed via an intermediate wastewater conduit 2024 to a secondary tank assembly 2011, which comprises a tank in fluid communication with a pump, forces water out of the tank and into the secondary wastewater conduit 2003 via an intermediate wastewater conduit 2028, where wastewater may be conveyed to an external drain. In the event of overflow or if the pump of the primary tank assembly 2010 fails, wastewater may be conveyed to a secondary tank assembly 2011 either from the primary tank assembly 2010 through a conduit 2013, or from an external dialyzer via a secondary wastewater conduit 2024 provided in fluid communication with external dialyzer wastewater connectors 2021. In the event the pumps of both primary and secondary tank assemblies fail, wastewater may drain through an emergency wastewater conduit 2004 provided in fluid communication with an external valve 2005 or to an external drain. Freshwater overflow and pressure may be managed through one or a plurality of conduits 2025 and 2026, which may relay freshwater in or out of the system through an external connection.

Figure 3:
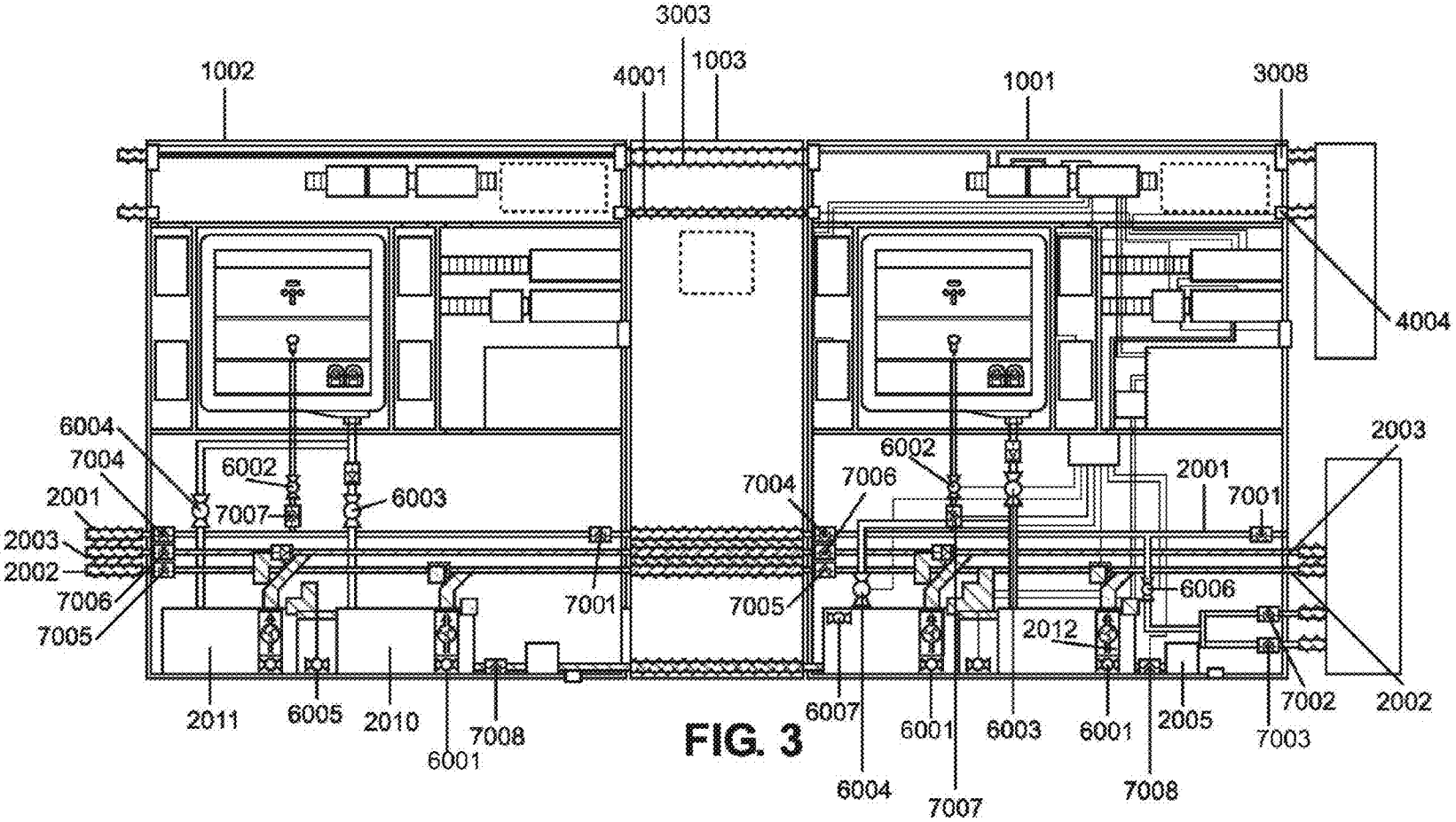
FIG. 3 is a component map of an exemplary configuration of the disclosure displaying two standalone consoles, a unit with connections to facility utilities and data and an intermediate or end-of-line unit, in fluid, electrical, and data communication with one another via a coupler panel showing exemplary sensor and valve locations with exemplary sensors and valves shown.

FIG. 1 also illustrates exemplary power and data subsystems, including an exemplary wiring map in a console unit functionally connected to facility utilities 1001 for placement of sensors and valves and communication of data and electricity between and among console components, shown in greater exemplary detail in FIG. 3. Electricity may be conveyed into the relay line from an external source through a power input 3008 which may connect to facility utilities or another console unit. Electricity may be conveyed through a primary conduit 3003, which may be provided in electrical communication with a power distribution block 3004 to convey power to the systems of each individual console unit and to subsequent console units in a relay line. Circuit breakers housed within one or a plurality of breaker boxes 3002 may be provided in electric communication with a power distribution block 3004 to prevent overcurrent and distribute electricity at appropriate loads to external receptacles 3006 for dialyzers, accessories, or personal devices, and to one or a plurality of relay blocks 3009, the latter through a voltage transformer 3007. A set of relay blocks 3009 may provide power to a relay module 3005, which may be a 12 volt DC relay module, to power and monitor sensors and valves within each console unit. Breaker boxes 3002 may also convey power to and from a universal power system 3001 which may provide backup power to the system in the event of an external power failure. In an exemplary embodiment of the disclosure, a universal power system 3001 may power a variable frequency drive 3010, which in turn supplies power to and controls the pumps of the primary and secondary tank assemblies. Power may also be routed from the voltage transformer 3007 to a network hub 4002. A network hub 4002 may receive information from another console or an external source through an external connector 4004, which may comprise an Ethernet port or wireless network system. Data may be communicated via data communication cabling 4001 to an external data port 4012, to which the data subsystem of another console or coupler panel may be connected. A network hub 4002 may be connected to an external data port 4003 capable of communicating information and commands to and receiving information and commands from an external dialyzer. A control and monitor panel 1008 capable of displaying the status of each or multiple consoles' subsystems may be disposed in the cabinet's exterior.

Figure 2:
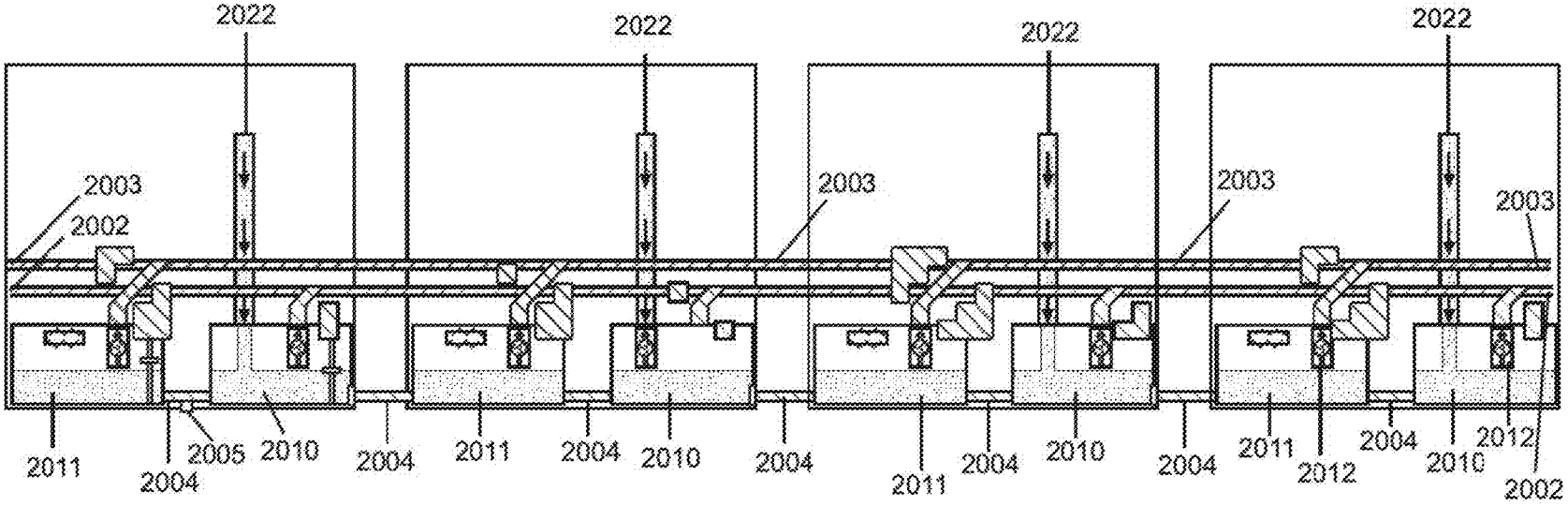
FIG. 2 is component map of an exemplary configuration of a plurality of consoles provided in fluid communication with one another configured to provide plumbing redundancies via parallel drain shedding.

FIG. 2 is component map of an exemplary configuration of a plurality of consoles configured to provide plumbing redundancies via parallel drain shedding. In this embodiment, the use of macerator pumps 2012 is exemplary and non-limiting. In this exemplary configuration under normal operating conditions, used dialysate is conveyed through a wastewater conduit 2022 to a primary tank assembly 2010. A primary tank assembly 2010, which comprises a tank in fluid communication with a macerator pump 2012, grinds any solids in the wastewater into finer particles and forces water out of the tank and into the primary wastewater conduit 2002, where wastewater may be conveyed to an external drain. A secondary tank assembly 2011, which comprises a tank in fluid communication with a macerator pump 2012, grinds any solids in the wastewater into finer particles and forces water out of the tank and into the secondary wastewater conduit 2003, where wastewater may be conveyed to an external drain. In the event of overflow or if the pump of the primary tank assembly 2010 fails, wastewater may be conveyed to a secondary tank assembly 2011 from a primary tank assembly 2010 through an emergency wastewater conduit 2004. In the event the pumps of both primary and secondary tank assemblies fail, wastewater may also drain through an emergency wastewater conduit 2004 provided in fluid communication with an external valve 2005 or to an external drain.

FIG. 3 is a component map displaying an exemplary configuration of a two-unit relay line of console units provided in functional communication via a coupler panel 1003. In this exemplary embodiment, valves may be electronically actuated and controlled, although it may be desirable for fresh water and drainage system intake and output valves conveying water and wastewater to and from each console to be manually actuated. In this exemplary configuration under normal operating conditions, fresh water enters the relay line through the fresh water conduit 2001 and supplies external dialyzers with fresh water passing through an intermediate conduit and an external connector. A freshwater intake valve 7001 disposed along the fresh water conduit 2001 before the intermediate conduit may control the flow of freshwater entering the console relay line and each individual console. A valve 7007 disposed along the intermediate fresh water conduit may control flow of fresh water to a dialyzer. Water temperature, pressure, and rate-of-flow may be measured by a sensor 6002 disposed between the intermediate fresh water conduit valve 7007 and the external connector for conveying fresh water to an external dialyzer. Used dialysate may return from the dialyzer wastewater connection and passes through a wastewater conduit with a sensor 6003 capable of measuring wastewater temperature, pressure, and flow rate to a primary tank assembly 2010. A primary tank assembly 2010, which comprises a tank in fluid communication with a pump 2012, pumps water out of the tank via an intermediate wastewater conduit into a primary wastewater conduit 2002, where wastewater may be conveyed to an external drain. A sensor 6001 provided in electronic communication with any pump 2012 may detect and communicate pump flow rate and water pressure of an associated pump to a monitoring panel or other monitoring components. A secondary tank assembly 2011, which comprises a tank in fluid communication with a pump, forces water out of the tank and into the secondary wastewater conduit 2003 via an intermediate wastewater conduit 2028, where wastewater may be conveyed to an external drain. A console unit functioning as an end-of-line unit may have a fresh water conduit valve 7004, a primary wastewater conduit valve 7005, and a secondary wastewater valve 7006 all closed, preventing outflow of wastewater or fresh water. Such valves may be electronically or manually actuated. In the event of overflow or if the pump of the primary tank assembly 2010 fails, wastewater may be conveyed to a secondary tank assembly 2011 either from the primary tank assembly 2010 through a secondary intermediate wastewater conduit provided in fluid communication with external dialyzer wastewater connector, on which a sensor 6004 capable of monitoring temperature and flow rate may be disposed, or from a first tank assembly 2010 via an emergency wastewater conduit. A sensor 6005 may be disposed along an emergency wastewater conduit providing fluid communication between two tank assemblies to detect flow rate and temperature of wastewater flowing from a first tank assembly 2010 to a second tank assembly 2011 or vice versa. In the event the pumps of both primary and secondary tank assemblies fail, an emergency wastewater conduit may be opened by a valve 7008 allowing wastewater to drain through an emergency wastewater conduit provided in fluid communication with an external valve 2005 or to an external drain. A sensor 6007 may be disposed within a tank assembly to measure wastewater volume and temperature within a holding tank. Freshwater overflow may be managed through one or a plurality of return conduits, which may be controlled by a primary valve 7002 and secondary valve 7003, which may carry freshwater out of the system through an external connection. A sensor 6006 may be disposed along a return conduit to measure flow rate of freshwater overflow.

FIG. 3 also illustrates exemplary power and data subsystems, including an exemplary wiring map in a console unit functionally connected to facility utilities 1001 and an exemplary component chart for intermediate and end-of-line console units 1002. Electricity may be conveyed into a relay line from an external source through a power input 3008 which may connect to facility utilities or another console unit. Electricity may be conveyed through a primary conduit 3003 to additional console units in a relay line either directly or through a coupler panel 1003. Data may be communicated throughout the relay line and to and from external computing systems via data communication cabling 4001. A console series may receive information from another console or an external source through an external connector 4004, which may comprise an Ethernet port or wireless network system.

Figure 4:
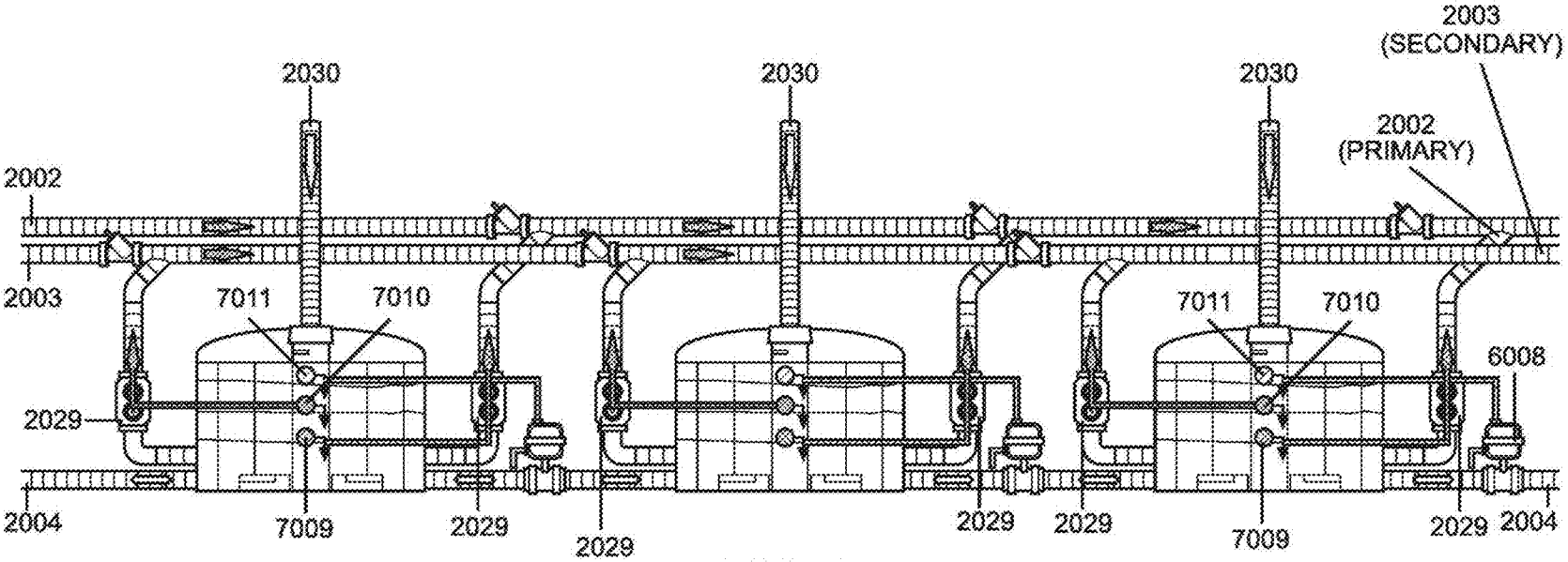
FIG. 4 illustrates an exemplary drain system utilizing multiple pumps provided in fluid communication with an individual wastewater tank, in which analog float sensors are disposed at three levels within a storage tank and used to control the motor speed of a plurality of pumps provided in fluid communication with a storage tank.
Figure 13:
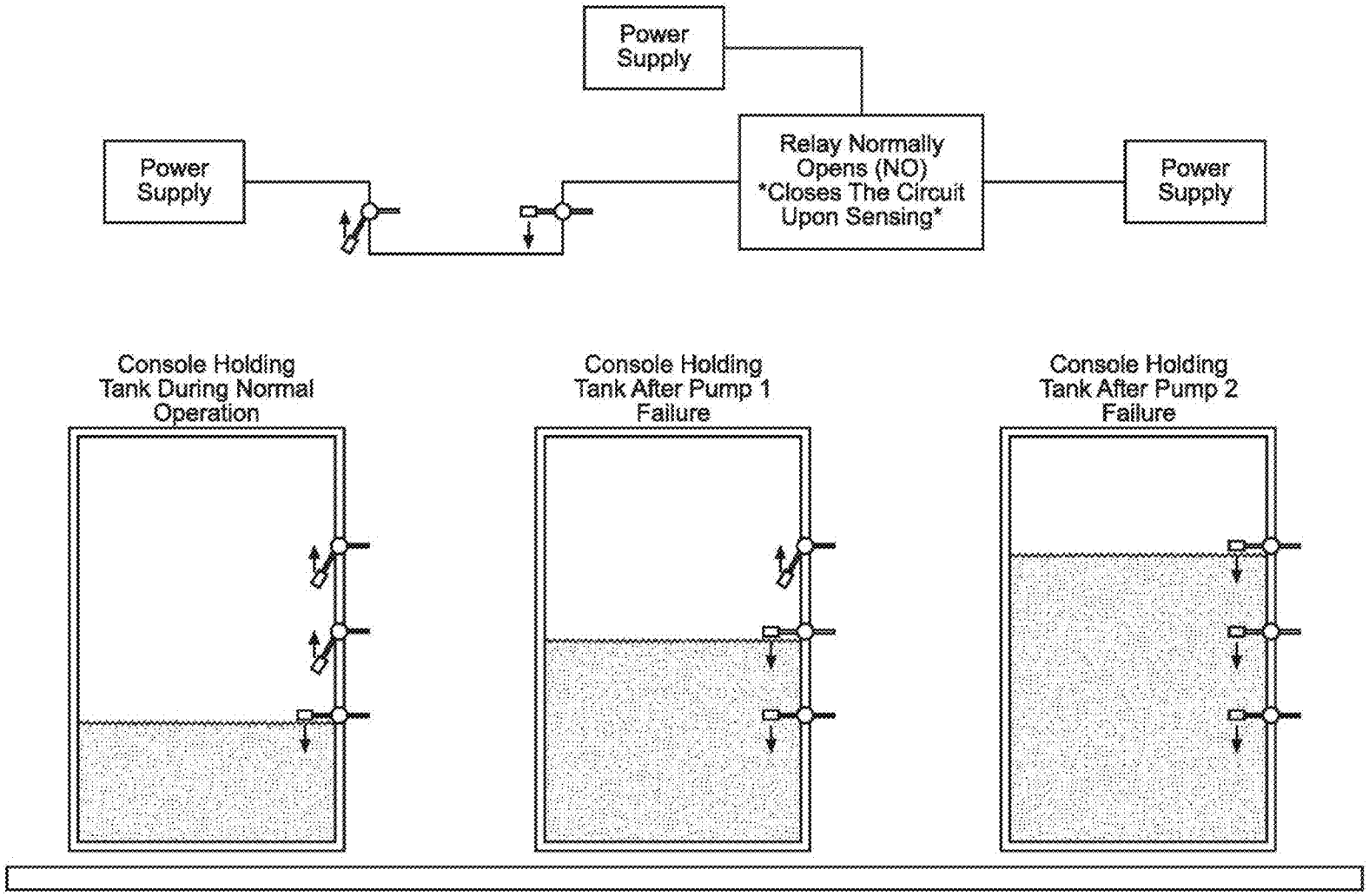
FIG. 13 illustrates a mechanical relay diagram and control logic of backup pump activation in the event of a primary pump failure.
Figure 14:
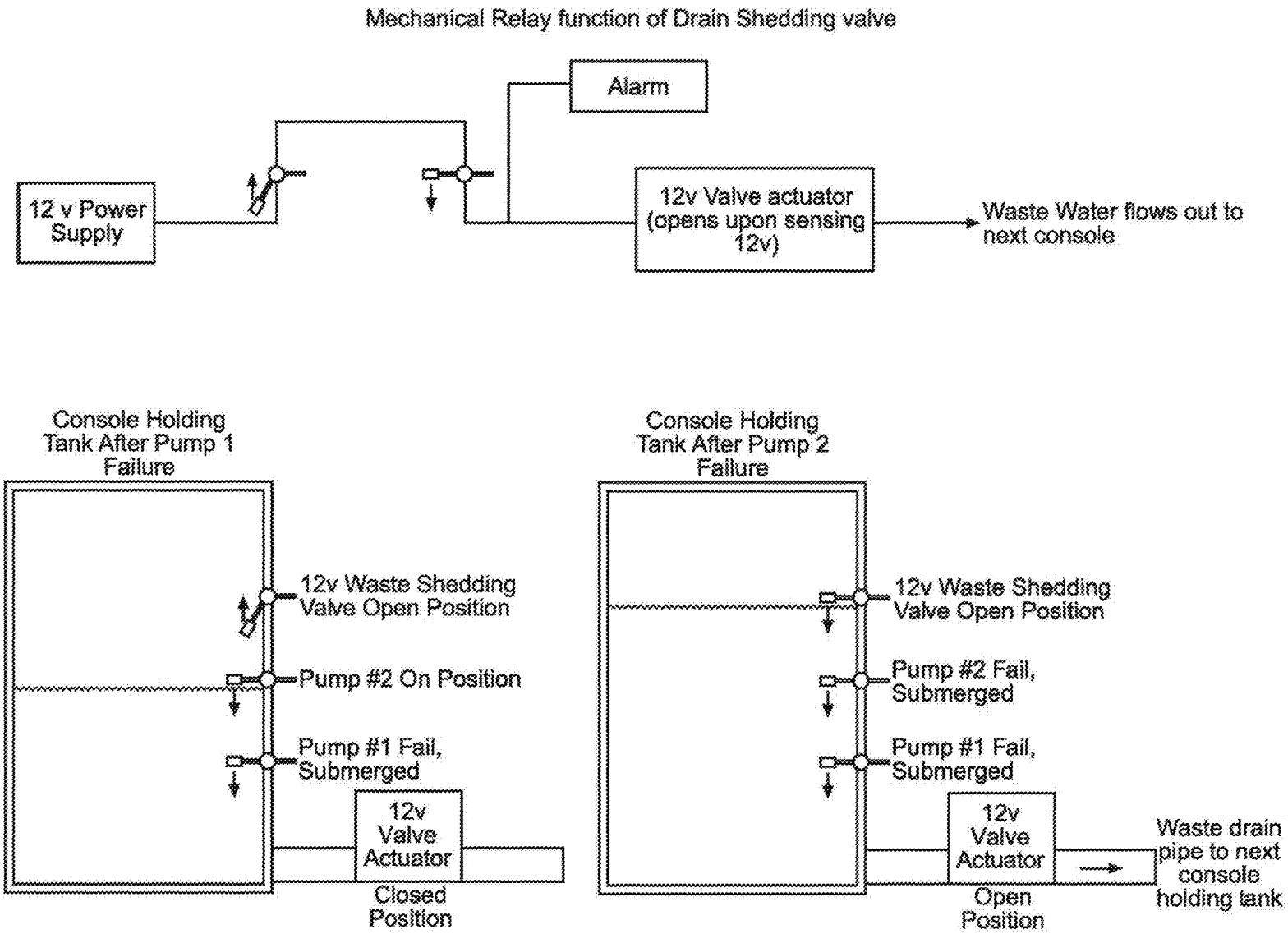
FIG. 14 illustrates a diagram of the mechanical relay function of an exemplary drain shedding valve.

FIG. 4 illustrates an exemplary drain system comprising three tank assemblies in which analog float sensors are disposed at three levels within a storage tank provided in fluid communication with two pumps 2029, with a first provided in fluid communication with a primary wastewater conduit 2002, and a second pump provided in fluid communication with a secondary wastewater conduit 2003. These sensors may be used to control the motor speed of a pump configured to control the wastewater level of an exemplary holding tank and/or to open an electronically-actuated valve 6008 configured to open and allow one exemplary tank to drain to another in the event of a single or double pump failure. Wastewater from a dialyzer enters an exemplary tank assembly via a wastewater conduit 2030. When wastewater reaches the level of a first float sensor 7009 a pump 2029 provided in fluid communication with the tank and a primary wastewater conduit 2002 activates, conveying wastewater to the primary wastewater conduit 2001. If wastewater reaches the height of a second float sensor 7010, a second pump 2029 in fluid communication with a secondary wastewater conduit 2003 may activate, conveying additional wastewater from the holding tank to a secondary wastewater conduit 2003. If wastewater reaches the height of a third float sensor 7011, an electronically-actuated valve 6008 opens, allowing wastewater to drain from one tank assembly to another via an emergency wastewater conduit 2004. FIG. 13 illustrates the function of exemplary float sensors and FIG. 14 illustrates the mechanical relay function of the float sensors, including activation of the backup pump and drain shedding. An individual tank assembly or a plurality of tank assemblies may be disposed within a single console unit. The illustration does not portray connections between individual consoles units or coupler panels, but such connections may be present.

Figure 5:
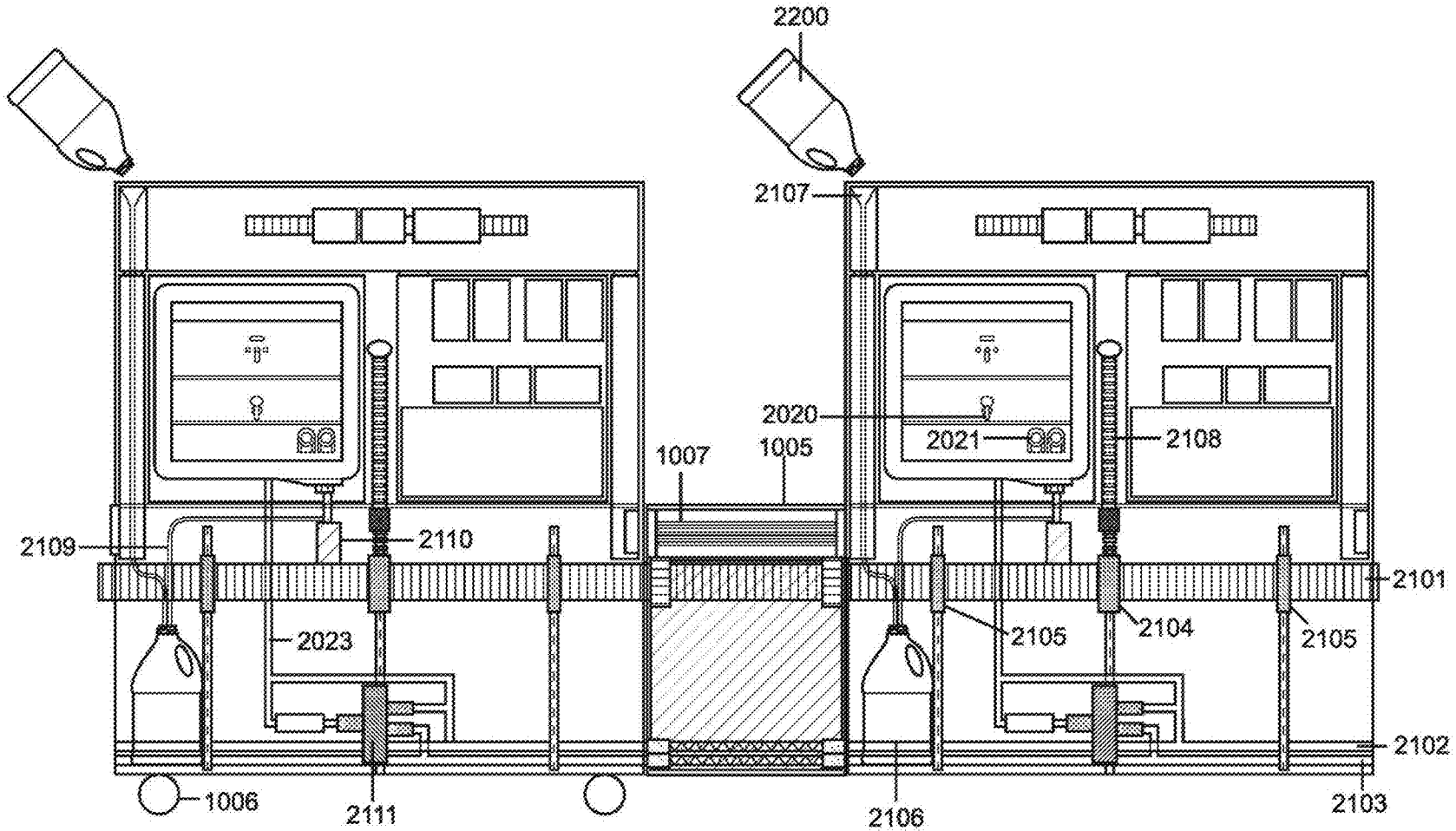
FIG. 5 illustrates an exemplary component map of a plurality of utilities consoles optionally configured to use gravity to effect the drainage and collection of used dialysate or other medical-waste byproducts, with the slope and height of the wastewater conduit able to be adjusted within each individual module unit and coupler panel.

FIG. 5 is an exemplary component map of a portable biomedical utilities console configured to use gravity to effect the drainage and collection of used dialysate or other medical-waste byproducts. Wastewater from an external dialyzer may enter the wastewater drainage system through an external connector 2021 configured to receive wastewater from a dialyzer, and is conveyed by an intermediate wastewater conduit 2110 to a primary wastewater conduit 2101. In this exemplary illustration, the height of each section of the primary wastewater conduit within each console unit is adjustable at three locations, allowing the height and slope of the primary wastewater conduit 2101 to be set at a gradient slope that continues throughout the relay line, descending until the primary wastewater conduit 2101 reaches an external drain. Height adjustment may be effected in a number of ways, including fixing the primary wastewater conduit to the interior of each console units at appropriate heights. A preferred mode to ensure modularity of individual console units is to include hardware that allows height and slope of sections of primary wastewater conduit to be set and reset or adjusted should the user desire to reconfigure a relay line. In this exemplary illustration, height and slope adjustments may be made by sliding an anchor protruding from the side of a plurality of collars 2105 disposed around the primary wastewater conduit 2101 into one of a series of vertical openings disposed in a vertically-oriented rail affixed within each console unit. A pipe collar may also be affixed to the lower extremity of a screw mechanism 2108, allowing the elevation of a pipe collar 2104 to be raised and lowered at fine increments by turning the screw. Wastewater may also be directed from an external dialyzer through a secondary intermediate wastewater conduit 2109 to a removable receptacle 2106. A console unit may include a conduit for cleaning solution to be communicated from an external opening to the removable wastewater receptacle 2106. A container 2200 positioned over a funnel 2107 disposed in the exterior of the left-side console housing illustrates a method of cleaning the drain system from built-up proteins and other biological debris via the use of chemical cleaning agents.

FIG. 5 also illustrates an exemplary fresh water supply with adjustable temperature, which may be used with gravity-enabled or pump-assisted wastewater draining configurations. A cold fresh water conduit 2102 and a hot fresh water conduit 2103 may be provided in fluid communication with external sources of cold and hot water, respectively, and with conduits passing through individual console units and coupler panels 1005. Within each console unit, a cold fresh water conduit 2102 and a hot fresh water conduit 2013 may be provided in fluid communication with a thermostatic mixing valve 2111 configured to mix water of hot and cold temperatures and convey tempered water via an intermediate fresh water conduit 2023 to a fresh water output 2020 configured to provide fresh water to an external dialyzer. Wheels 1006 may be affixed to the bottom of each console unit and coupler panels 1005, which may also be provided at a more compact height with data and power cabling 1007 connected to individual console units at a lower height.

Figure 6A:
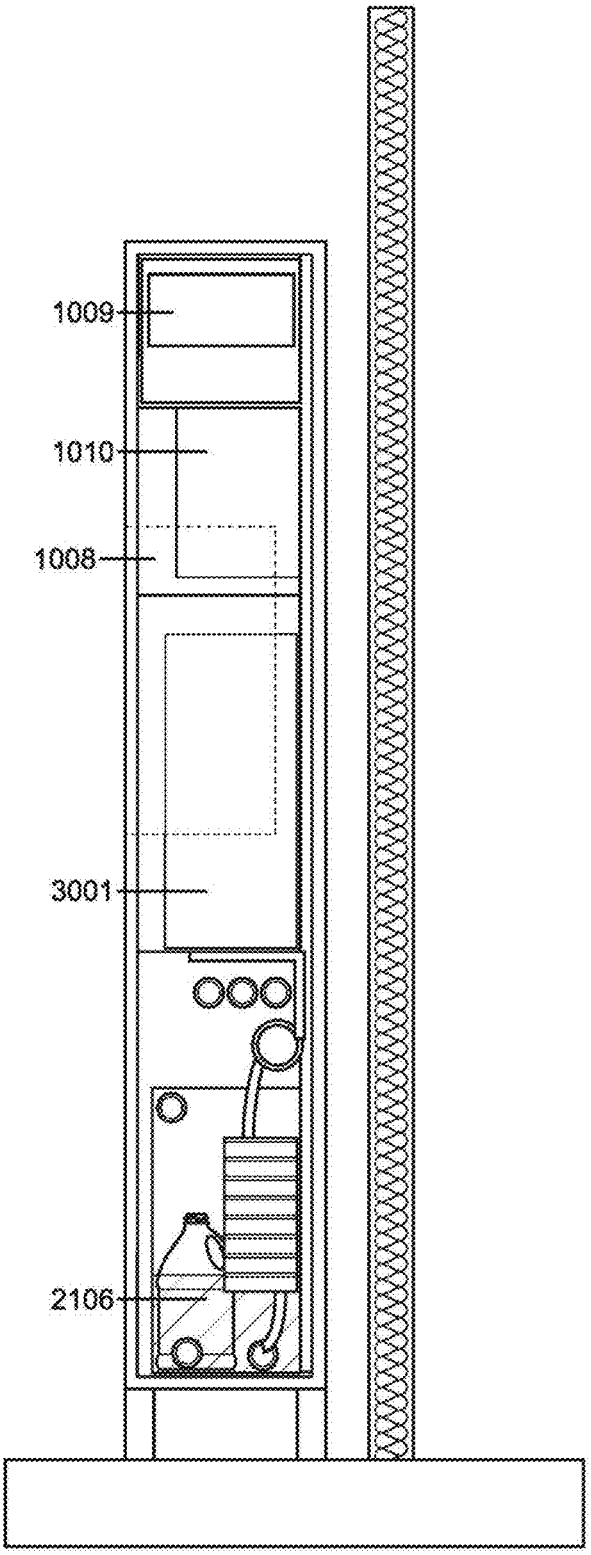
FIG. 6A is a lateral view of an exemplary component map of a portable biomedical utilities console configured to use gravity to effect the drainage and collection of used dialysate or other medical-waste byproducts showing exemplary locations of power distribution, power backup, power controls and relays, supply space, and a used dialysate receptacle.

FIG. 6A is a lateral view of an exemplary component map of a portable biomedical utilities console configured to use a drainage pump placed against a standard permanent wall. Power distribution components 1009 are disposed near the top of each console unit above control and relay components 1010, with a universal power system 3001 configured to provide emergency power disposed below. A storage cabinet 1008 may be disposed within each console unit. In a preferred embodiment, a removable wastewater receptacle 2106 is placed on the bottom of the interior of each console unit to ensure downward flow of wastewater.

Figure 6B:
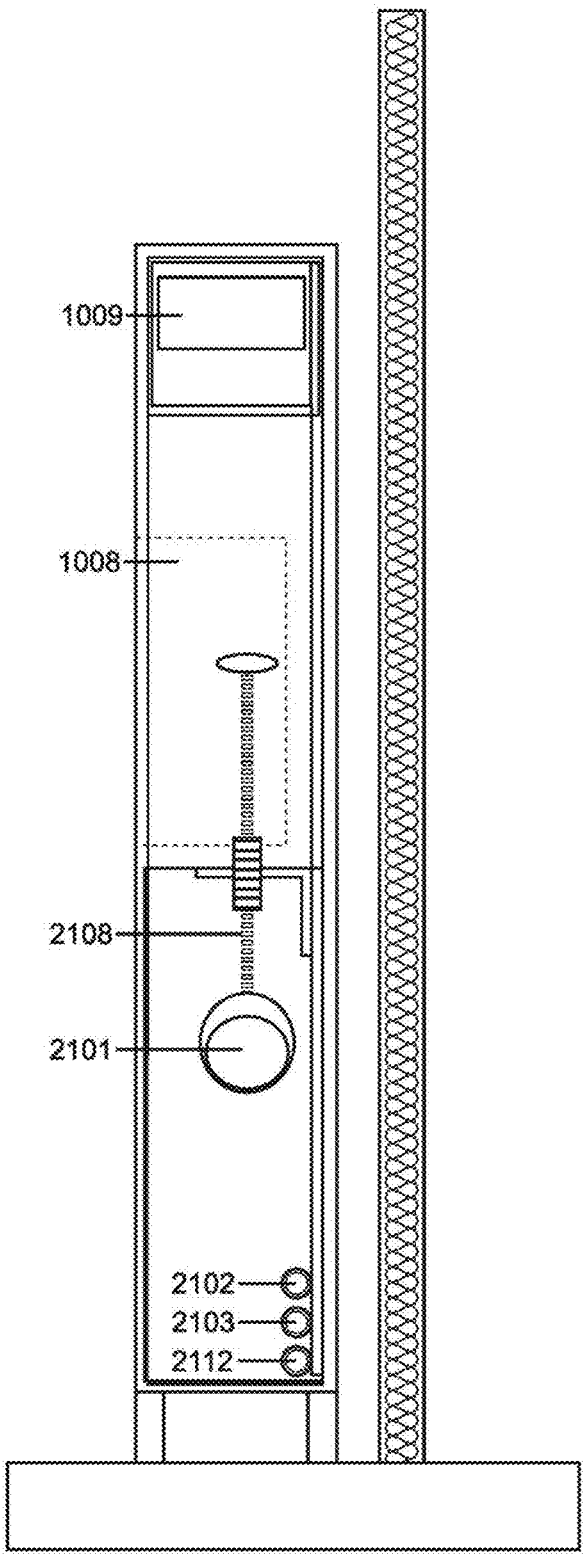
FIG. 6B is a lateral view of an exemplary component map of a portable biomedical utilities console configured to use gravity to effect the drainage and collection of used dialysate or other medical-waste byproducts showing exemplary locations of power distribution components, supply space, and the primary drain line.

FIG. 6B is a lateral view of an exemplary component map of a portable biomedical utilities console configured to use gravity-assisted drainage placed against a standard permanent wall. Power distribution components 1009 are disposed near the top of each console unit. A storage cabinet 1008 may be disposed within each console unit. A primary wastewater conduit 2101 may be disposed at adjustable elevations through the use of a screw mechanism 2108. A cold fresh water conduit 2102, a cold fresh water conduit 2103, and a tepid fresh water conduit 2112 may be disposed near the bottom and affixed to the side of the interior of each console unit.

Figure 7:
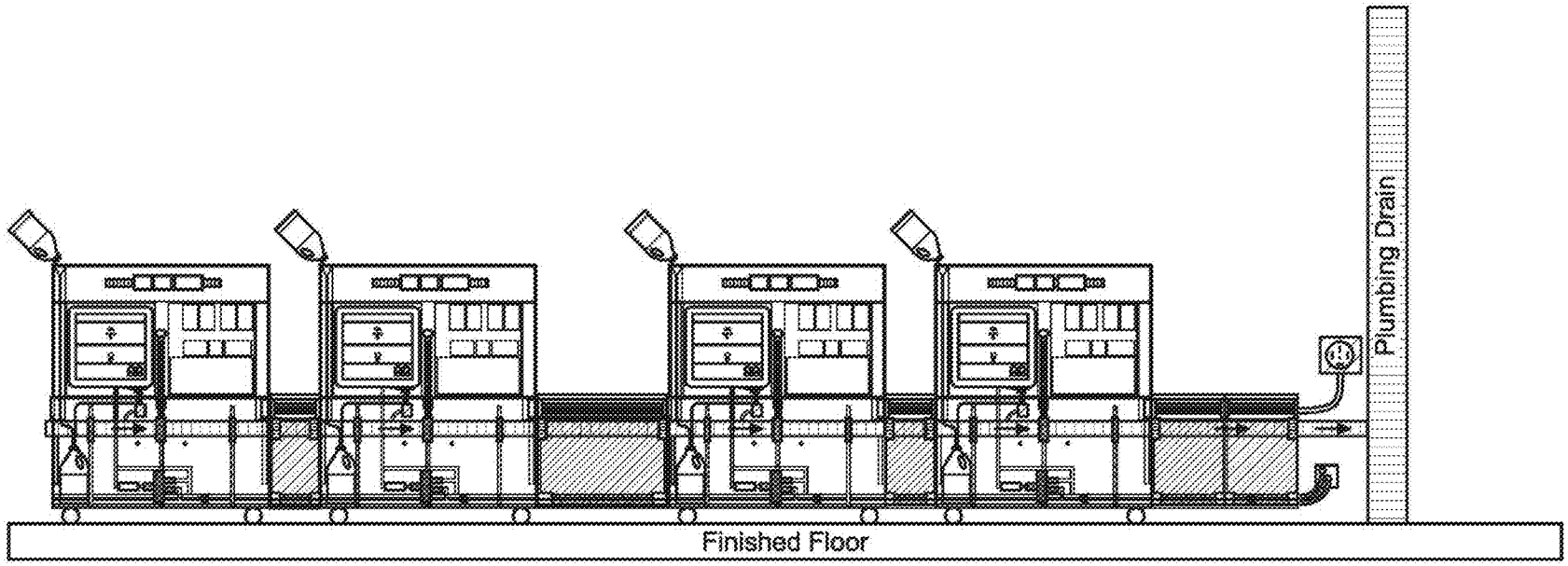
FIG. 7 illustrates an exemplary configuration of a plurality of utilities consoles optionally configured to use gravity to effect the drainage and collection of used dialysate or other medical-waste byproducts, with primary drainage conduit adjusted such that the height of the conduit is highest at the left-most cabinet, and is disposed at progressively lower heights as the conduit gets closer to the plumbing drain of the dialysis facility to allow wastewater to travel to the facility's plumbing drain.

FIG. 7 illustrates an exemplary component map of a plurality of utilities consoles optionally configured to use gravity to effect the drainage and collection of used dialysate or other medical-waste byproducts provided in fluid and electric communication with one another via a plurality of adjustable coupler panels configured to convey water, wastewater, electricity, and data among the consoles with the console relay line provided in fluid communication with external hot and cold water lines, a drainage line in fluid communication with an external plumbing drain, and the main power bus provided in electric communication with an external power source. In an ideal embodiment, the wastewater conduit of the relay line would be configured at a slope that is highest in the left-most console unit, and lowest at the right-most console unit adjacent to the plumbing drain.

Figure 8:
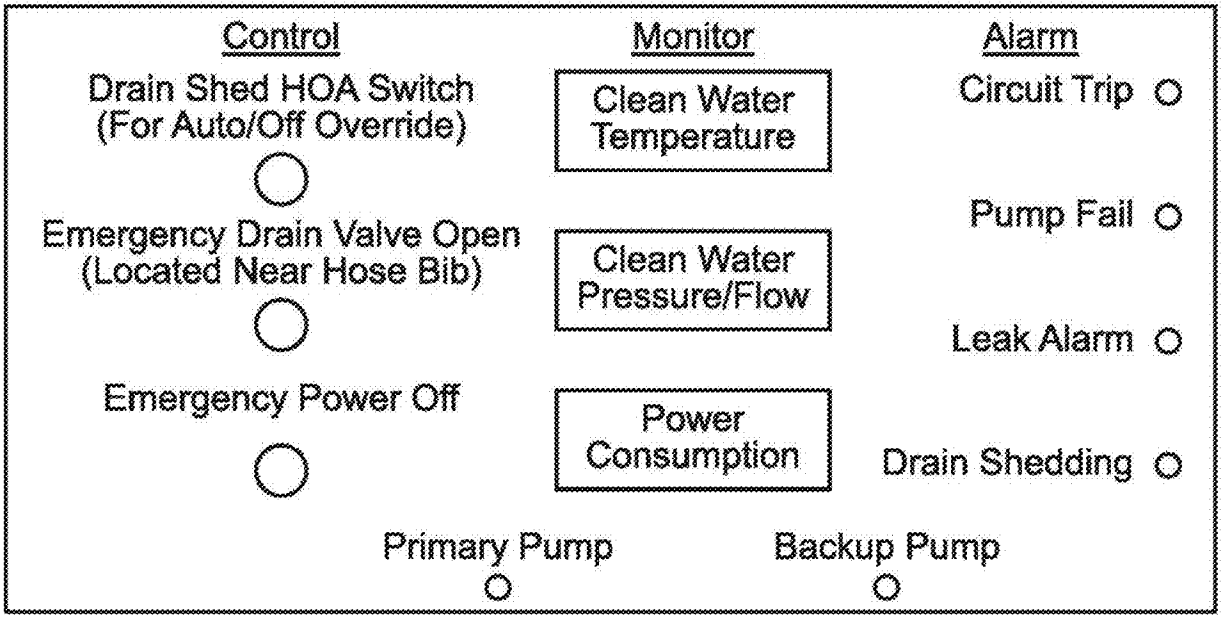
FIG. 8 illustrates an exemplary illustration of a control and monitor panel.

FIG. 8 is an exemplary control panel displaying emergency information and information pertaining to the normal operation of a portable biomedical utilities console, including in this embodiment, clean water temperature, pressure and rate of flow, and system power consumption.

Figure 9A:
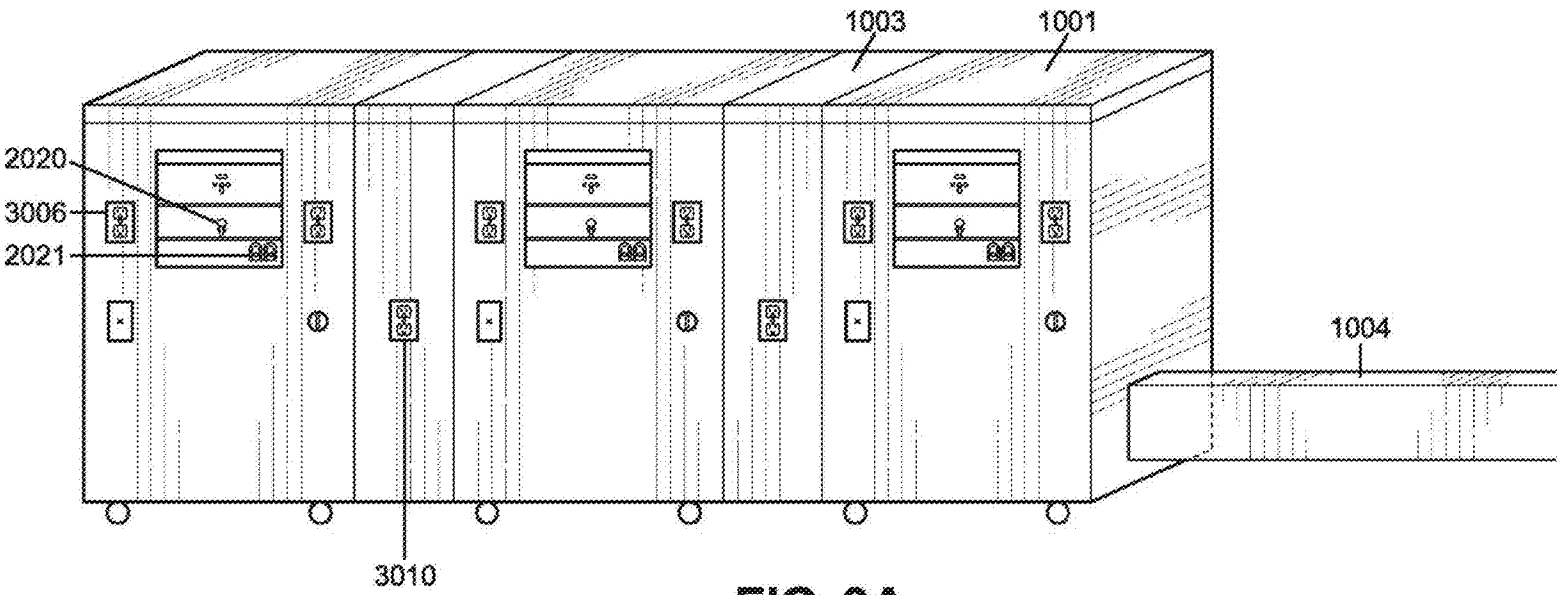
FIG. 9A is a perspective view of an exemplary exterior of multiple consoles connected to one another via coupler panel cabinets and a chase panel encasing electric, data, and fluid utility lines.

FIG. 9A is a perspective view of an exemplary exterior of multiple consoles connected to one another via adjustable coupler panel cabinets and a chase panel encasing piping configured to convey wastewater from the consoles and clean water to the console relay system. Plumbing, data, and power from external sources, such as from connections in a facility, may be communicated to a relay line of console units via a low profile chase panel 1004. A console unit 1001 may be functionally connected to a coupler panel 1003, which in turn may be functionally connected to another console unit. Alternatively, console units 1001 may be functionally connected to one another. FIG. 9A also illustrates other exemplary external features such as electrical receptacles 3006, fresh water supply connectors 2020 configured to attach to and convey fresh water to an external dialyzer, and a wastewater return connector 2021 configured to receive used dialysate wastewater from an external dialyzer. Electrical receptacles 3010 may also be disposed in coupler panels. Amenities such as television displays may also be disposed in coupler panels. Exteriors of all components may be finished in a variety of aesthetically pleasing manners, including wood or faux-wood paneling or stainless steel.

Figure 9B:
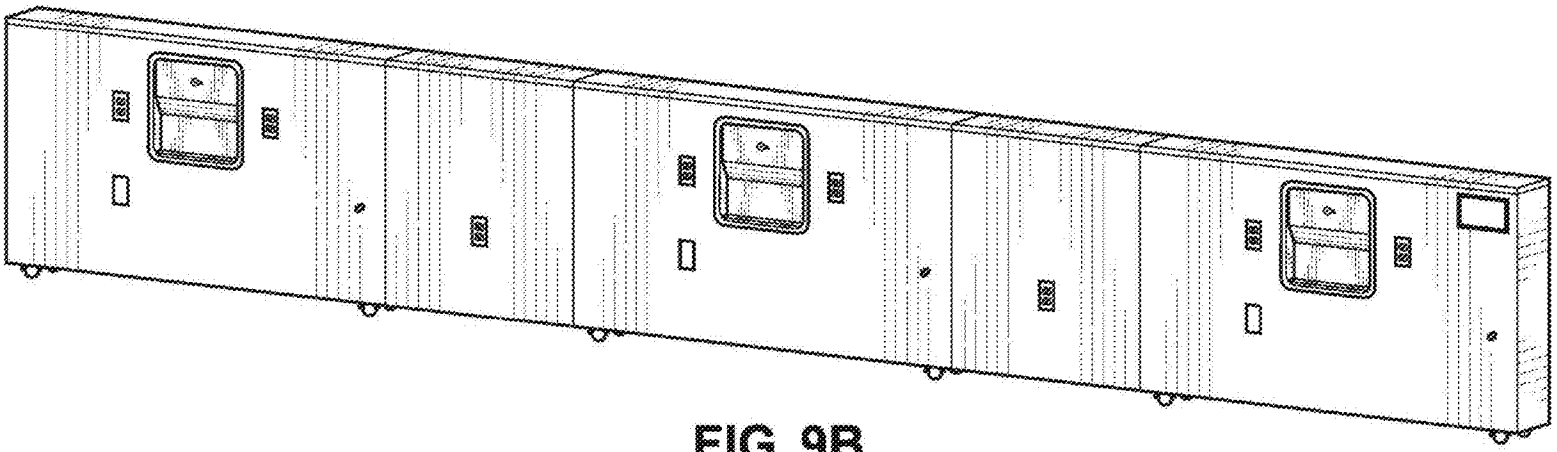
FIG. 9B is a perspective view of the exterior of three exemplary portable biomedical utilities consoles provided in functional communication with each other with coupler panels between them.

FIG. 9B is an external perspective view of three exemplary portable biomedical utilities consoles provided in functional communication with each other via a pair of exemplary adjustable coupler panels.

Figure 10B:
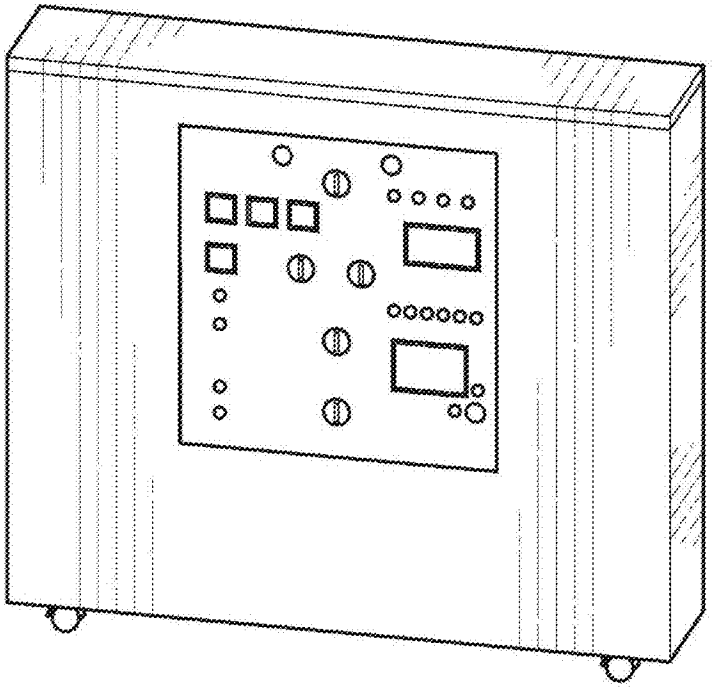
FIG. 10B is a second external perspective view of an exemplary head end monitor and control unit configured to monitor and control one or a plurality of portable biomedical utilities consoles.
Figure 10A:
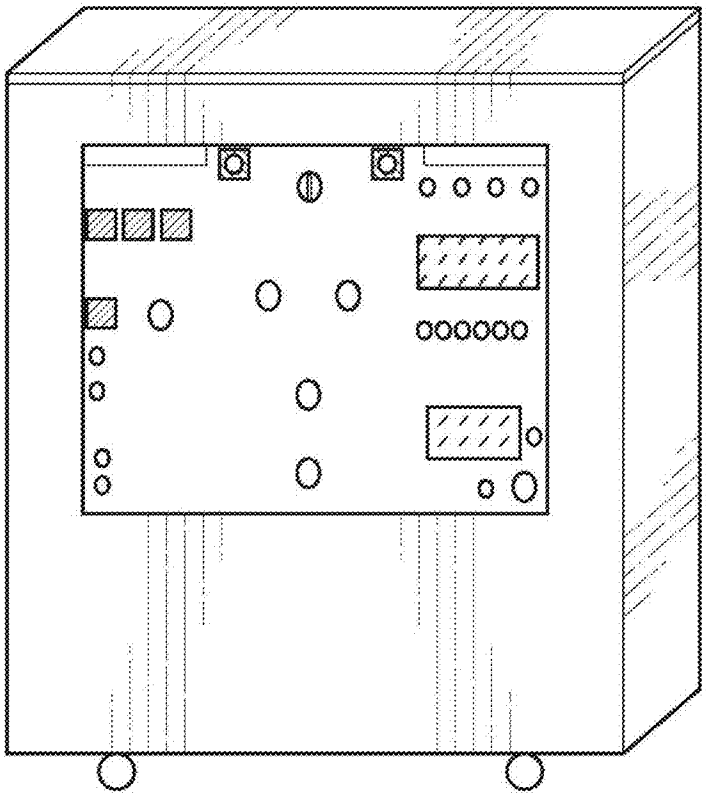
FIG. 10A is an external perspective view of an exemplary head end monitor and control unit configured to monitor and control one or a plurality of portable biomedical utilities consoles.

FIG. 10A is an external perspective view of an exemplary head end monitor and control unit configured to monitor and control one or a plurality of portable biomedical utilities consoles.

FIG. 10B is an external perspective view of an exemplary head unit control panel.

Figure 11A:
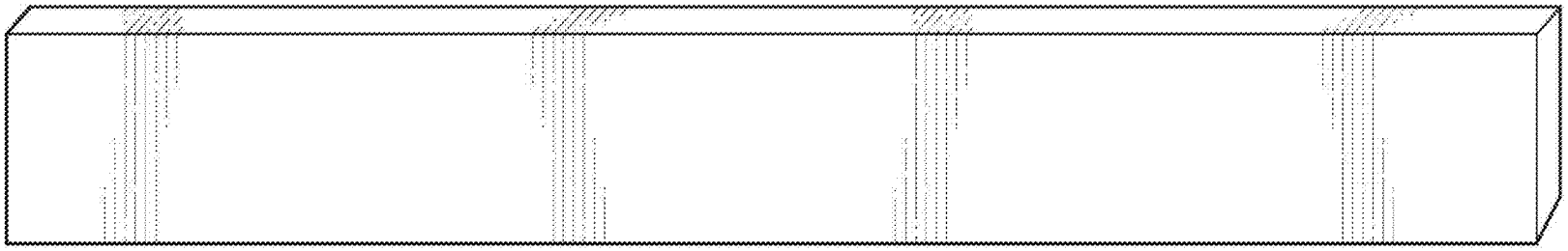
FIG. 11A illustrates an exterior perspective view of the exemplary chase panel.

FIG. 11A illustrates an exterior perspective view of an exemplary chase panel.

Figure 11B:
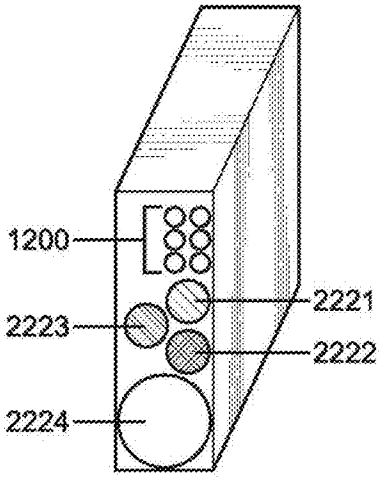
FIG. 11B illustrates a cross-section of an exemplary chase panel of FIG. 11A.

FIG. 11B illustrates a cross-section of an exemplary chase panel, showing a cold fresh water conduit 2221, a hot fresh water conduit 2222, a tepid fresh water conduit 2223, a wastewater conduit 2224, which may comprise a PVC pipe, and conduits for electricity and data 1200, with the exterior housing provided in a finish that may be matched to the external housing of any consoles used therewith.

Figure 12:
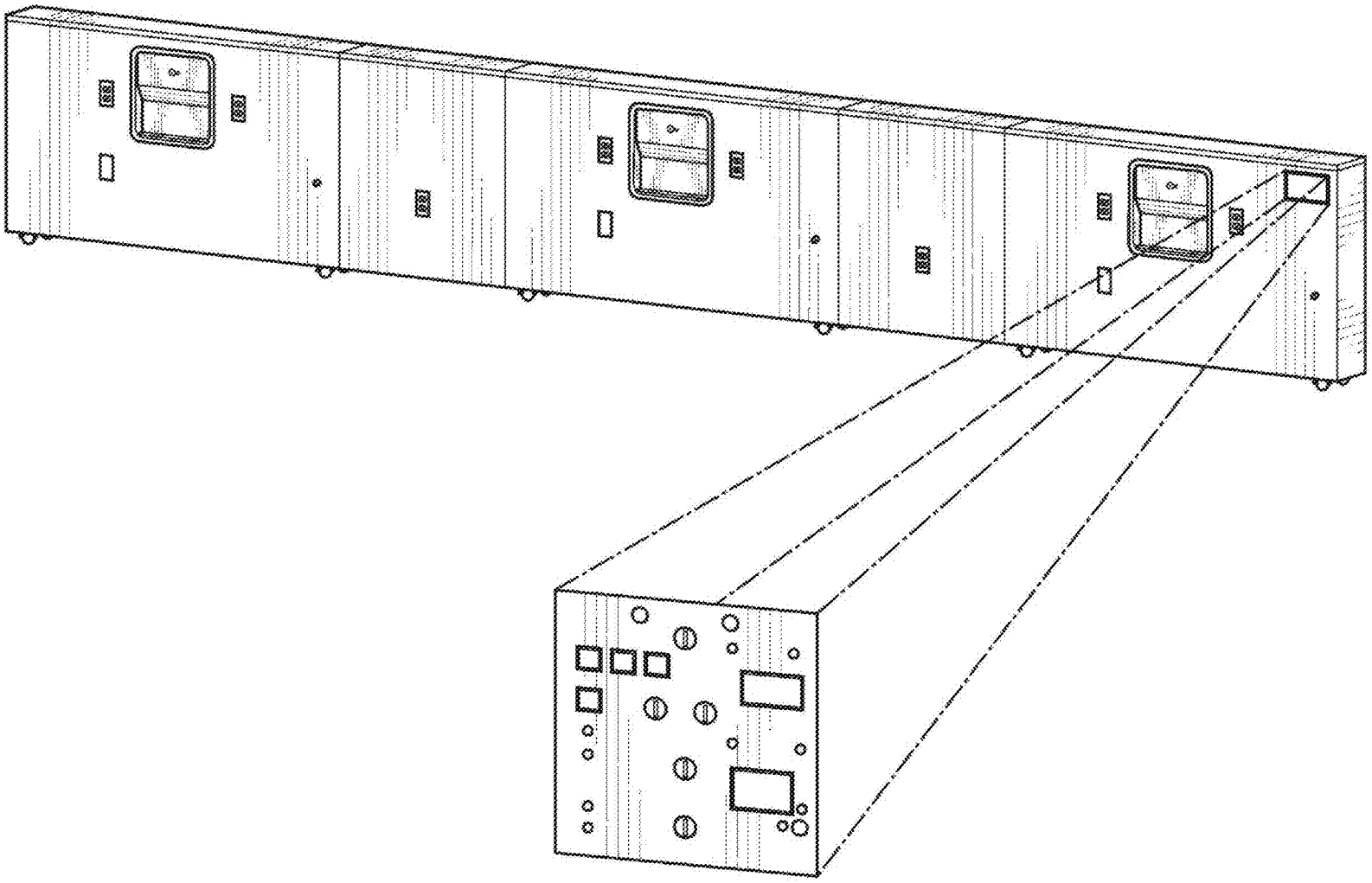
FIG. 12 illustrates a front view of an exemplary monitoring display that may be disposed on the exterior housing of an exemplary portable biomedical utilities console and an external perspective view of three exemplary portable biomedical utilities consoles provided in functional communication with each other.

FIG. 12 is an external perspective view of three exemplary portable biomedical utilities consoles provided in functional communication with each other via a pair of exemplary adjustable coupler panels, and illustrates a front view of an exemplary monitoring display that may be disposed on the exterior housing of an exemplary portable biomedical utilities console.

FIG. 13 illustrates a mechanical relay diagram and control logic of backup pump activation in the event of a primary pump failure. The sensors illustrated herein represent mechanical float switches.

FIG. 14 illustrates a lateral diagram of the mechanical relay function of an exemplary drain shedding valve, in which an exemplary electrically-actuated valve is actuated to an open position to allow wastewater to drain to the drain subsystem of an adjacent console. The top illustration shows the function of the highest float sensor, illustrating that when wastewater in a first holding tank reaches the height of the highest sensor, an alarm activates and drain shedding is accomplished by activating an actuator that opens a valve provided in fluid communication with a first holding tank and a second holding tank, allowing wastewater to drain from a first holding tank to a second holding tank. The use of a 12 volt power supply and valve actuators is exemplary and nonlimiting.

Figure 15:
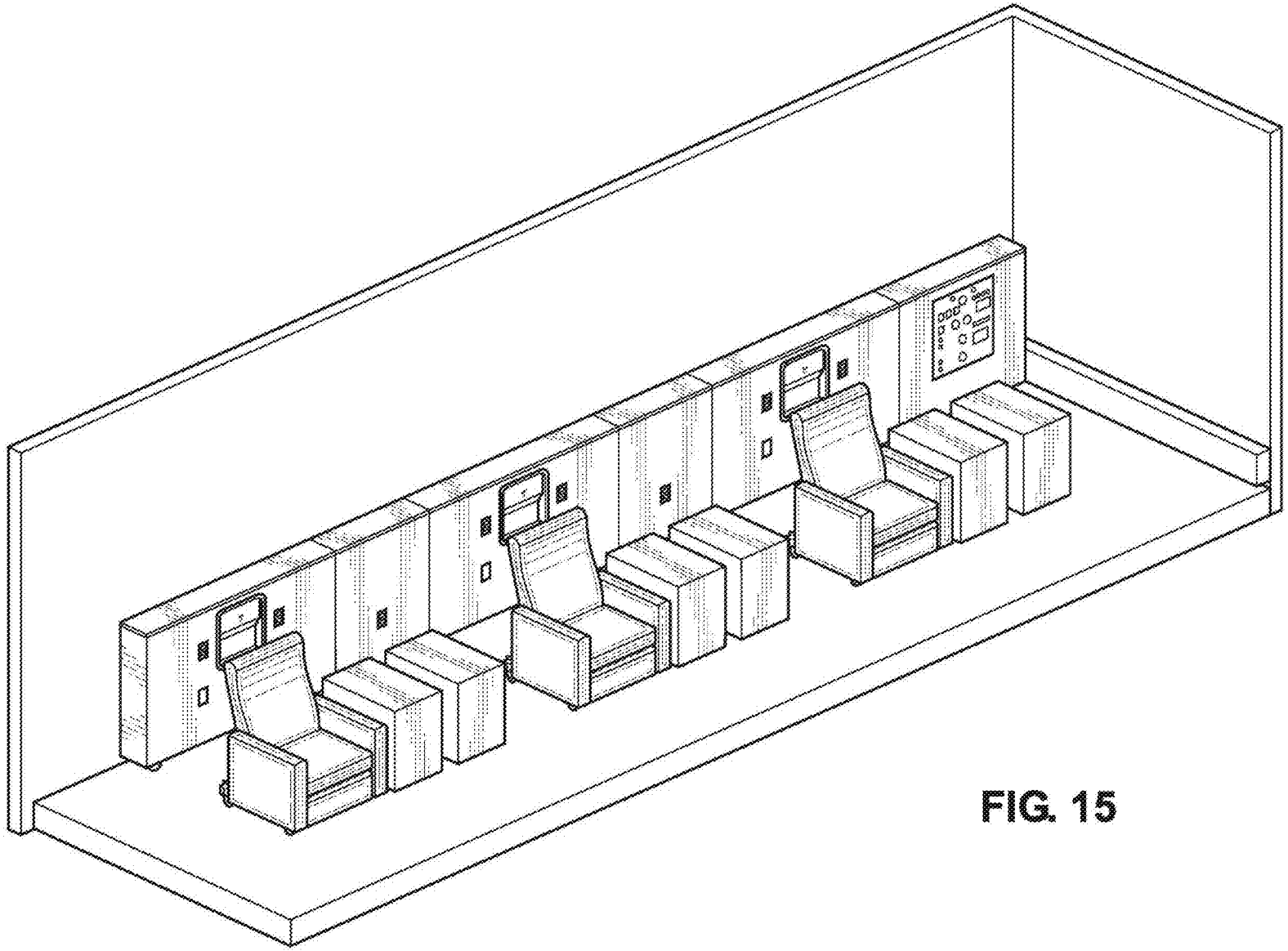
FIG. 15 is a perspective view of an arrangement of a plurality of exemplary consoles configured in a series (or relay line) and separated by exemplary adjustable coupler panels with an exemplary head unit control panel provided at the right side of the relay, and an exemplary chase panel provided to the right side of the exemplary head unit with exemplary dialysis treatment chairs placed in exemplary fashion before a respective supporting console.

FIG. 15 is a perspective view of an arrangement of a plurality of exemplary consoles configured in a relay line and separated by exemplary adjustable coupler panels with an exemplary head unit control panel provided at the right side of the relay, and an exemplary chase panel provided to the right side of the exemplary head unit with exemplary dialysis treatment chairs placed in exemplary fashion before a respective supporting console.

Figure 16:
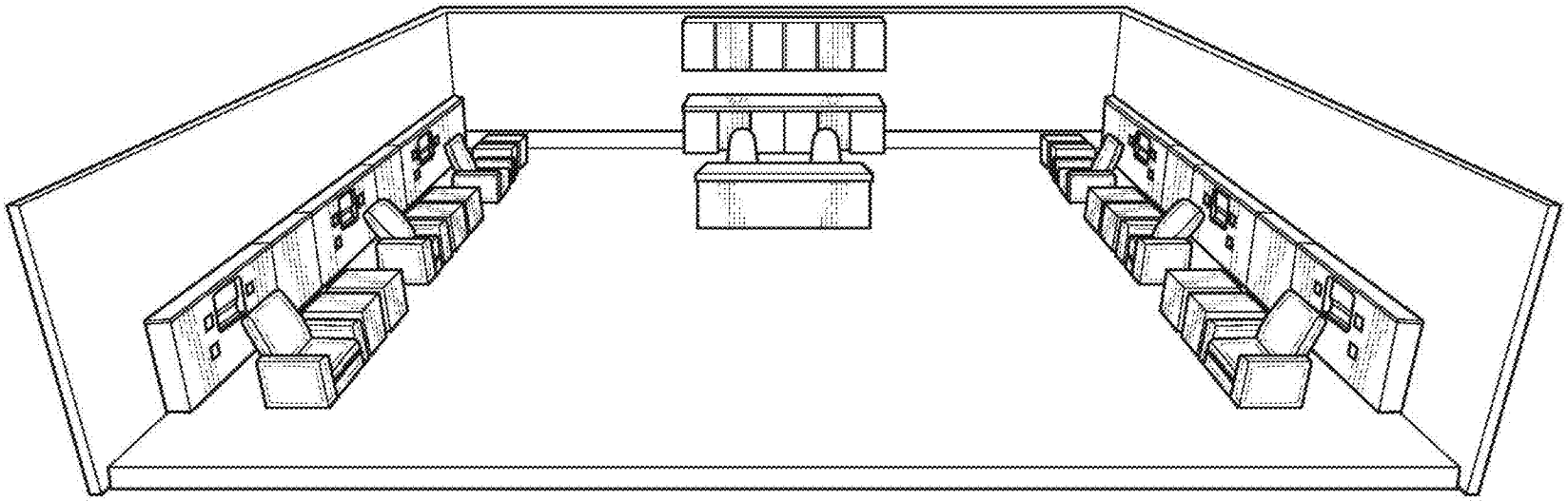
FIG. 16 is a perspective view of an exemplary dialysis or other treatment room layout incorporating the use of a plurality of portable biomedical utilities console systems as shown in FIG. 15.

FIG. 16 is a perspective view of an exemplary dialysis or other treatment room layout incorporating the use of a plurality of portable biomedical utilities console systems as shown in FIG. 15.

Figure 17:
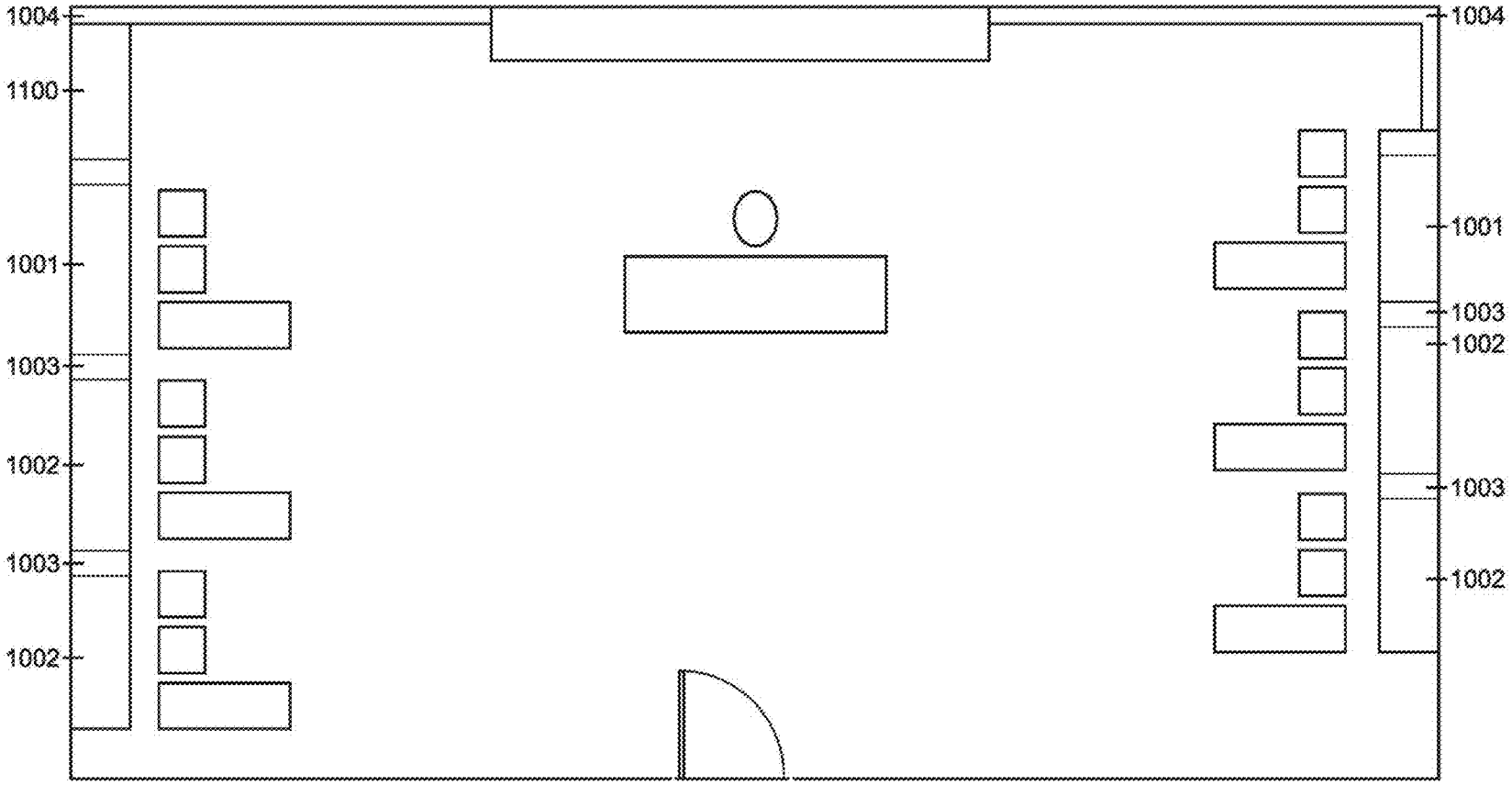
FIG. 17 is a top view of an exemplary dialysis or other treatment room layout incorporating the use of a portable biomedical utilities console system comprising a plurality of utilities consoles, a plurality of adjustable coupler panels, and a single head end monitor and control unit.

FIG. 17 is a top view of an exemplary dialysis or other treatment room layout incorporating the use of a portable biomedical utilities console system comprising a plurality of utilities consoles, a plurality of adjustable coupler panels, and a single head end monitor and control unit. Chase panels 1004 may convey fresh water and power to and wastewater from a relay line of console units, as well as provide data communication to and from a relay line, which may be comprised of console units configured to be connected to external utilities 1001, provided in functional communication with coupler panels 1003, which in turn may be provided in functional communication with intermediate and end-of-line console units 1002. Coupler panels may be used to add space between consoles, each of which services a single dialyzer and patient. In this way, patients may have more space while undergoing dialysis treatment.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A portable biomedical utilities system for use with dialysis equipment comprising:

a plurality of modular cabinets housing power, data, and plumbing subsystems wherein the subsystems of each modular cabinet are functionally connected to respective power, data, and plumbing subsystems of at least one other modular cabinet, said subsystems including:

a. a power subsystem of a first modular cabinet capable of receiving power from an external source, powering the components of said first modular cabinet and a first dialyzer, and conveying power to a second modular cabinet;

b. a second power subsystem of a second modular cabinet capable of receiving power from a first modular cabinet powering the components of said second modular cabinet and powering the components of a second dialyzer, and conveying power to another modular cabinet;

c. a data subsystem of each modular cabinet capable of receiving and transmitting data to and from an external data system and other modular cabinets; and d. a plumbing subsystem of each modular cabinet comprising:

i. a fresh water conduit capable of communicating fresh water from an external source or another modular cabinet, and to another cabinet and a dialyzer; and ii. a wastewater conduit provided in fluid communication with a dialyzer and capable of receiving dialysis wastewater, wherein:

a height and a slope of said wastewater conduit is configured by setting the height of the conduit at a plurality of locations along said wastewater conduit such that the wastewater conduits of a relay line of modular cabinets are capable of conveying wastewater via a sloping conduit comprising the wastewater conduits of a plurality of modular cabinets, wherein said sloping conduit slopes toward an external drain.

2. The portable biomedical utilities system of claim 1, wherein a removable receptacle for dialysis wastewater is provided in fluid communication with a dialyzer and a wastewater conduit.

3. The portable biomedical utilities system of claim 1, wherein the power subsystems of each modular cabinet comprise an uninterruptible power supply module, an inverter, and an alarm system configured to notify medical providers of an external power failure.

4. The portable biomedical utilities system of claim 1, wherein the height and slope of said wastewater conduit is set by adjusting the height of a series of a plurality of pipe collars supporting the wastewater conduit wherein the height of each said pipe collar is adjustably affixed to a fixed structure disposed within a modular cabinet.

5. The portable biomedical utilities system of claim 1, wherein said fresh water conduit comprises separate hot and cold water conduits provided in fluid communication with a thermostatic mixing valve capable of controlling the temperature water communicated to a dialyzer.

6. The portable biomedical utilities system of claim 1, wherein two modular cabinets arranged in a series are functionally connected by a coupler cabinet capable of communicating power, data, fresh water, and wastewater between two modular cabinets.

7. A portable biomedical utilities system for use with dialysis equipment comprising:

a plurality of modular cabinets housing power, data, and plumbing subsystems wherein the subsystems of each modular cabinet are functionally connected to respective power, data, and plumbing subsystems of at least one other modular cabinet, said subsystems including:

a. a power subsystem of a first modular cabinet capable of receiving power from an external source, powering the components of said first modular cabinet and a first dialyzer, and conveying power to a second modular cabinet;

b. a power subsystem of a second modular cabinet capable of receiving power from a first modular cabinet powering the components of said second modular cabinet and powering the components of a second dialyzer, and conveying power to another modular cabinet;

c. a data subsystem of each modular cabinet capable of receiving and transmitting data to and from an external data system and other modular cabinets; and d. a plumbing subsystem of each modular cabinet comprising:

i. a fresh water conduit capable of communicating fresh water from an external source or another modular cabinet, and to another cabinet and a dialyzer;

ii. a first tank assembly comprising a tank and a pump provided in fluid communication with a dialyzer, a first wastewater conduit, and a second tank assembly and capable of receiving dialysis wastewater from a dialyzer and communicating wastewater to a first wastewater conduit under pressure and a second tank assembly without pressure;

iii. a first wastewater conduit provided in fluid communication with and capable of receiving dialysis wastewater from a first tank assembly and another modular cabinet and communicating wastewater to another modular cabinet or an external drain;

iv. a second tank assembly comprising a tank and a pump provided in fluid communication with a dialyzer, a second wastewater conduit, and a first tank assembly and capable of receiving dialysis wastewater and communicating wastewater to a second wastewater conduit under pressure and a first tank assembly without pressure; and v. a second wastewater conduit provided in fluid communication with and capable of receiving dialysis wastewater from a second tank assembly and another modular cabinet and communicating wastewater to another modular cabinet or an external drain.

8. The portable biomedical utilities system of claim 7, wherein the power subsystems of each modular cabinet comprise an uninterruptible power supply module, an inverter, and an alarm system configured to notify medical providers of an external power failure.

9. The portable biomedical utilities system of claim 7, wherein said fresh water conduit comprises separate hot and cold water conduits provided in fluid communication with a thermostatic mixing valve capable of controlling the temperature water communicated to a dialyzer.

10. The portable biomedical utilities system of claim 7, wherein said first tank assembly is provided in fluid communication with a hose bib.

11. The portable biomedical utilities system of claim 7, wherein the pump in each said first and second tank assemblies comprises a macerator pump.

12. The portable biomedical utilities system of claim 7 wherein two modular cabinets arranged in a series are functionally connected by a coupler cabinet capable of communicating power, data, fresh water, and wastewater between two modular cabinets.

13. A portable biomedical utilities system for use with dialysis equipment comprising:

a plurality of modular cabinets housing power, data, and plumbing subsystems wherein the subsystems of each modular cabinet are functionally connected to respective power, data, and plumbing subsystems of at least one other modular cabinet, said subsystems including:

a. a power subsystem of a first modular cabinet capable of receiving power from an external source, powering the components of said first modular cabinet and a first dialyzer, and conveying power to a second modular cabinet;

b. a power subsystem of a second modular cabinet capable of receiving power from a first modular cabinet powering the components of said second modular cabinet and powering the components of a second dialyzer, and conveying power to another modular cabinet;

c. a data subsystem of each modular cabinet capable of receiving and transmitting data to and from an external data system and other modular cabinets; and d. a plumbing subsystem of each modular cabinet comprising:

i. a fresh water conduit capable of communicating fresh water from an external source or another modular cabinet, and to another cabinet and a dialyzer;

ii. a tank assembly comprising a tank and a plurality of pumps provided in fluid communication with a dialyzer, a first wastewater conduit, a second wastewater conduit, and another tank assembly and capable of receiving dialysis wastewater from a dialyzer and communicating wastewater to a first wastewater conduit and second wastewater conduit under pressure and another plumbing subsystem without pressure;

iii. a first wastewater conduit provided in fluid communication with and capable of receiving dialysis wastewater from a tank assembly and another modular cabinet and communicating wastewater to another modular cabinet or an external drain;

iv. a second wastewater conduit provided in fluid communication with and capable of receiving dialysis wastewater from a tank assembly and another modular cabinet and communicating wastewater to another modular cabinet or an external drain.

14. The portable biomedical utilities system of claim 13, wherein the power subsystems of each modular cabinet comprise an uninterruptible power supply module, an inverter, and an alarm system configured to notify medical providers of an external power failure.

15. The portable biomedical utilities system of claim 13, wherein two modular cabinets arranged in a series are functionally connected by a coupler cabinet capable of communicating power, data, fresh water, and wastewater between two modular cabinets.

16. The portable biomedical utilities system of claim 13, wherein said fresh water conduit comprises separate hot and cold water conduits provided in fluid communication with a thermostatic mixing valve capable of controlling the temperature water communicated to a dialyzer.

17. The portable biomedical utilities system of claim 13, wherein said tank assembly is provided in fluid communication with a hose bib.

18. The portable biomedical utilities system of claim 13, wherein each tank assembly comprises a plurality of sensors capable of measuring the amount of wastewater contained within each tank, the sensors provided in electronic communication with one or a plurality of pumps associated with each tank assembly, the sensors configured to activate one or a plurality of pumps as the volume of wastewater increases past one or a plurality of set points.

19. The portable biomedical utilities system of claim 13, wherein the pumps in each said tank assembly comprise a macerator pump.

* * * * *